US005108282A

United States Patent [19]

Pardo

[11] Patent Number: 5,108,282

[45] Date of Patent: Apr. 28, 1992

[54] BIAXIAL CONCRETE MASONRY CASTING APPARATUS

[75] Inventor: Jorge Pardo, Reston, Va.

[73] Assignee: National Concrete Masonry Association, Herndon, Va.

[21] Appl. No.: 495,973

[22] Filed: Mar. 20, 1990

Related U.S. Application Data

[63] Continuation-in-part of Ser. No. 298,342, Jan. 17, 1989, Pat. No. 4,909,970, which is a continuation of Ser. No. 23,941, Mar. 10, 1987, abandoned, which is a continuation of Ser. No. 698,373, Feb. 4, 1985, abandoned.

[51] Int. Cl.[5] ..... B28B 7/30

[52] U.S. Cl. ..... 425/227; 249/64; 249/141; 249/145; 249/151; 249/176; 249/178; 249/184; 425/414; 425/438; 425/812

[58] Field of Search ..... 425/138, 150, 219, 220, 425/253, 255, 413, 414, 227, 228, 438, 812; 249/27, 37, 63, 64, 144, 145, 148, 151, 152, 176, 180, 184, 66.1, 141, 178; 264/40.1, 40.5, 333, 334, 336

[56] References Cited

U.S. PATENT DOCUMENTS

| | | | |
|---|---|---|---|
| 738,423 | 9/1903 | Durant | 249/145 |
| 1,202,038 | 10/1916 | Eastman | 249/145 |
| 1,321,938 | 11/1919 | Norton | 249/37 |
| 1,548,485 | 8/1925 | Quimby | 249/145 |
| 1,623,560 | 4/1927 | Sherman | 249/145 |
| 2,587,413 | 2/1952 | Vander Heyden | 425/413 |
| 2,680,276 | 6/1954 | Filangeri | 249/145 |
| 3,415,482 | 12/1968 | Schmidgall | 249/145 |
| 4,101,255 | 7/1978 | Fernaeus et al. | 425/219 |
| 4,909,717 | 3/1990 | Pardo | 249/145 |
| 4,909,970 | 3/1990 | Pardo | 264/40.5 |

FOREIGN PATENT DOCUMENTS

| | | | |
|---|---|---|---|
| 586242 | 3/1925 | France | 249/145 |

*Primary Examiner*—James C. Housel
*Attorney, Agent, or Firm*—Lowe, Price, LeBlanc & Becker

[57] ABSTRACT

A CM block machine for casting masonry blocks includes a mold cavity formed between a mold box and a mold core containing one or more plungers selectively extending laterally into the cavity along a second axis which is normal to the axis of casting so as to form openings extending through portions of the block in the direction of the second axis. The plunger(s) is disposed in a cartridge housing contained within the mold core. An oversized vibrating ring wiper mounted in the cartridge housing engages the external periphery of the plunger to prevent CM material from entering the cartridge during plunger retraction. The plunger includes an annular relief chamber formed in a side wall thereof to provide an additional volume of air from within the cartridge to an air passage communicating with the plunger end face to prevent vacuum from impeding plunger retraction. A circular air filter is disposed in the annular chamber to prevent dirt and CM material from entering the cartridge interior through the air passage and annular chamber. The plunger width is preferably less than its length to ensure the CM material poured into the mold cavity occupies portions of the cavity located beneath the plunger. A hollow core bar supporting the mold core within the mold box protectively houses air tubings extending to the mold core to supply compressed air for selective plunger movement.

13 Claims, 10 Drawing Sheets

BIAXIAL CONCRETE MASONRY CASTING APPARATUS

RELATED APPLICATIONS

The present application is a continuation-in-part of Ser. No. 07/298,342, filed Jan. 17, 1989, now U.S. Pat. No. 4,909,970, issued Mar. 20, 1990, which is a continuation of Ser. No. 07/023,941, filed Mar. 10, 1987, abandoned, which is a continuation of Ser. No. 06/698,373, filed Feb. 4, 1985, abandoned.

TECHNICAL FIELD

The present invention relates generally to apparatus and methods for casting concrete masonry blocks and, more particularly, to biaxially or triaxially casting such blocks by forming openings or indentations in the block walls along an axis normal to the flow of the CM material during casting.

BACKGROUND OF THE INVENTION

FIG. 1 is an illustration of a biaxially cast twin cavity CM block 30*a* formed with a biaxial CM casting apparatus depicted in FIGS. 9–11 which is also disclosed in my above '342 application, the disclosure of which is hereby incorporated by reference herein in its entirety. Biaxial cast CM block 30*a* comprises longitudinally parallel face shells 31 interconnected by two laterally extending end webs 32*a* and a center web 34*a*. The face shells 31 and the three webs 32*a*, 34*a* form two cavities 35 which extend through the block 30*a* from the top 37 to the bottom 38 thereof in the direction of the flow of CM material during casting of biaxially cast CM block 30*a*.

The biaxially cast CM block 30*a* differs from a conventional CM block in that there are openings or apertures 40 extending through each of the end webs 32*a* and the center web 34*a* with the axis of each opening 40 being substantially normal to the direction of material flow during casting (i.e., the "axis of casting"). The openings 40 in the webs 32*a* and 34*a* are made by varying the mold aperture during casting and timing such variations of mold aperture to result in variation of the shape of the CM block 30*a* by providing openings 40 which are formed normal to the axis of casting without a secondary manufacturing operation, as further below explained.

The openings 40 in webs 32*a* and 34*a* are located on, the block's vertical center line which is mid-way between the outer surfaces of block face shells 31; and the center of openings 40 may also be located at or slightly below the block's horizontal center line which is at the vertical mid-point of the block between the top and bottom thereof.

With reference to FIGS. 10, the biaxial CM mold core system 41 as disclosed in my aforesaid application includes a pair of mold core assemblies 42,44 plus a core bar assembly 46 for installing the system 41 in a commercially available CM block casting machine 48 as depicted in FIG. 11, plus air supply means 50 for pneumatically operating the mold core assemblies 42 and 44. More specifically, the casting machine 48 includes a four-sided mold box with four vertically extending walls 54 at right angles to each other. Casting machine 48 also includes a compression and stripper shoe 56, a material feed tray 58, a strike off bar 59 and means for raising a pallet 60 to form the bottom of the mold for casting a CM block as generally known in the art and as hereinafter discussed.

Each mold core assembly 42,44 includes a generally rectangular shaped mold core 49 having opposing pairs of planar vertical side walls 51 and 53,53*a*, plus a horizontally disposed planar top end wall 55, and an open bottom 57 (FIG. 13). Mold cores 49 are similar to conventional mold cores used to make conventional twin cavity CM blocks, however, each mold core 49 is modified by cutting axially aligned circular apertures 59 in opposite sides 53, 53*a* thereof (FIG. 9). A cylindrical assembly sleeve 62 is disposed within each mold core 49 with opposite ends thereof mounted in apertures 59 in opposing side walls 53,53*a*. An "inner" axially reciprocating plunger 64 is mounted in one end of cylinder 62 in each mold core assembly 42 and 44 so that (1) each plunger 64 can be retracted inside of adjacent walls 53*a* of its mold core 49 as shown at the right of FIG. 9; and so that (2) such plunger 64 can project outside of the mold core walls 53*a* as shown at the left in FIG. 9. Another somewhat longer "outer" axially reciprocating plunger 66 is mounted in the other end of cylinder 62 of each mold core assembly 42,44 so that each plunger 66 can also be retracted inside of adjacent wall 53 of its mold core 49 a shown at the right of FIG. 9; and so that these plungers 66 can project outside of walls 53 as shown at the left in FIG. 9. The construction and mode of operation of the axial plungers 64,66 are the same in each mold core assembly 42 and 44.

In the preferred embodiment, the axial plungers 64 and 66 are energized to extend and retract by compressed air means although equivalent mechanical means, electromechanical means, hydraulic means, or a combination thereof, may also be utilized.

Reference is now made particularly to the schematic or diagrammatic drawings of FIGS. 2–8 which show components of a biaxial CM casting apparatus in various phases of a biaxial CM casting process for making biaxial CM blocks like 30*b* (or 30*a*, using end cores) by utilizing the present inventions herein.

Referring to FIG. 2, this is a schematic or diagrammatic illustration showing a biaxial CM mold core system 41 installed in the mold box 52 of the CM casting machine. The sides 53 of mold core assemblies 42 and 44 are disposed adjacent to, but suitably spaced from the two shorter sides 54 of mold box 52; and the sides 51 of mold core assemblies 42 and 44 are disposed adjacent to, but suitably spaced from the two longer sides 54*a* of the mold box 52. The other sides 53*a* of each mold core 49 of mold core assemblies 42 and 44 are inwardly disposed adjacent to but spaced from each other a suitable distance. Each of the plungers 64 and 66 of mold assemblies 42 and 44 is wholly retracted within the side walls 53 and 53*a* of its mold core 49. FIG. 2 shows a phase of operation of the biaxial CM casting apparatus and a step in the biaxial CM casting method according to both my prior and the present invention wherein the feed tray 58 containing the semifluid CM mix is off to the side of the mold 52, the compression/stripper shoe 56 is being moved on its way up to provide access for the feed tray 58 to the mold 52 and a conventional bottom pallet 60 is being moved upward to form the bottom of the mold 52.

In FIG. 3, the bottom pallet 60 forms the bottom of the mold 52, and the compression/stripper shoe 56 is above the level of the feed tray 58 which is moving into position over the mold box 52 for purposes of feeding the semifluid CM mix into mold 52. In this phase, all axial plungers 64 and 66 are caused by compressed air to project in extended position from the mold cores 49 so that the ends 67 of the longer axial plungers 66 abut against adjacent side walls 54 of the mold box 52 and the ends 65 of the shorter axial plunger 64 abut against each other.

In FIG. 4, semifluid CM mix 70 is fed into the cavity of mold 52 while axial plungers 64 and 66 are still extended from the mold core assemblies 42 and 44.

In FIG. 5, the feed tray 58 has been laterally withdrawn from its position over the mold 52 permitting a strike off bar 59 to pass horizontally above and in substantially scraping contact with the top end walls 55 of the mold core assemblies 51 so as to remove excess CM material extending upwardly from the cavities above the plane of the top end walls. Thereafter, compression/stripper shoe 56 comes down and compresses the CM mix 70 in the mold 52 as vibration of the mold proceeds by conventional means incorporated in CM casting machine 48. During this phase of operation said axial plungers 64 and 66 remain extended from the mold cores 42 and 44 to prevent CM mix 70 from filling in the spaces in mold 52 thus occupied by the portions of said extended plungers 64 and 66 projecting from both mold cores 49. This causes the formation of openings 40 in end webs **32*b* and in center web 34*a* of the biaxially cast CM block 32*b* shown in FIG. 1 (this is in contrast to conventionally cast twin-cavity CM blocks which have solid end and center webs due to use of conventional mold cores that do not incorporate axial plungers 64 and 66**, or other equivalent means.)

In FIG. 6, the axial plungers 64 and 66 are in the process of being retracted by compressed air to dispose said plungers 64 and 66 inside the walls of the mold cores 49 after completion of the block compression phase of the process described above with reference to FIG. 5.

In FIG. 7, the axial plungers 64 and 66 are fully retracted to within the side walls of the mold cores 49, whereby the compressed CM material formed into CM block **30*b* having three web openings 40 can be and is stripped from the cavity of mold 52 by simultaneous downward motion of the compression/stripper shoe 56 and bottom pallet 60**.

In FIG. 8, the compression/stripper shoe 56 returns upward past the mold core assemblies 42 and 44 and their axial plungers 64 and 66 which are retracted within the side walls of the mold cores 49, while the newly made biaxially cast CM block **30*b* is being ejected on its individual pallet 60** onto a conveyor.

After the compression/stripper shoe 56 moves upwardly out of and above the mold 52 the above-discussed steps of FIGS. 2–8 then may be and are repeated to carry out the next cycle for molding the next CM block **30*b*** in like manner.

The core bar assembly 46 and mounting system includes a conventional type commercially available core bar assembly comprising an elongated core bar 72 which has a configuration as shown in FIGS. 9–11 and is welded to the top end wall 45 of each of mold cores 49 (core bar 72 is usually made from high strength steel about one-half inch thick). Core bar 72 has a pair of mounting brackets 74 welded to its ends and extending perpendicular to the longitudinal axis of core bar 72. Each of mounting brackets 74 is provided with a pair of holes 75 for receiving four machine screws 76 to lock the CM mold core system 41 in place within mold box 52 to provide a biaxial CM casting mold for carrying out the biaxial CM casting process according to the present inventions.

Reference is now made especially to FIG. 9 for detailed description of mold core assemblies generally indicated by numerals 42 and 44. As previously noted, for convenience in disclosure of the invention herein, mold core assemblies 42 and 44 are the same in construction and mode of operation, but mold core assembly 42 is shown at the left of FIG. 9 with plungers 64 and 66 thereof extended, whereas mold core assembly 44 is shown at the right of FIG. 9 with plungers 64 and 68 retracted. It also is noted that, for convenience in disclosure of the invention herein, certain features of said like mold core assemblies 42 and 44 are shown in the mold core assembly 42 at the left of FIG. 9 but are not shown in the mold core assembly 44 at the right of FIG. 9, and vice versa. (Features within the scope of the preceding sentence are noted in description of mold core assemblies 42 and 44 with reference to FIG. 9.) It is further noted that, for convenience of disclosure of the invention herein, some features of each of like mold core assemblies 42 and 44 are shown in the section drawings of FIG. 9, in the same plane, whereas in actual construction some such features are not in the same plane but are angularly or otherwise displaced with respect to the longitudinal axis of cylindrical assembly sleeve 62. (Features within the scope of the preceding sentence are noted in description of mold core assemblies 42 and 44 with reference to FIG. 9.)

Still referring especially to FIG. 9, there is centrally disposed within cylindrical assembly sleeve 62 an elongated cylindrical manifold member generally indicated at 78 which extends through the central aperture of an annular-shaped ring generally indicated at 80. Ring 80 supports manifold member 78 and its related components; manifold 78 and ring 80 are in turn supported within the cylindrical assembly sleeve 62 (sometimes called "assembly cylinder 62" or "plungers assembly cylinder 62"). When assembled, cylinder 62, cylindrical manifold member 78 and annular-shaped manifold supporting ring 80 have substantially coincident longitudinal central axes.

The annular manifold support ring 80 is secured to the assembly cylinder 62 in the interior thereof by a plurality of machine screws like 81 extending through circumferentially spaced apertures 82 in the same plane in the wall of assembly cylinder 62 and respectively threaded into a plurality of drilled and threaded holes like 84 which extend radially into annular ring 80 from its outer periphery.

Manifold member 78 which extends through and is supported in the central aperture 83 of annular ring 80 also is laterally secured to ring 80 by a pair of like retaining rings 86 held in circular recessed grooves extending into the outer periphery of manifold member 78 on opposite sides of manifold support ring 80. The manifold member 78 is provided at each of its opposite ends with a reduced diameter hub 85 which is externally threaded at **85*a*. An annular stationary piston member generally indicated at 87 is secured to each of the opposite ends of manifold member 78 by means of threads in the central aperture 88 of piston members 87 mating with threads 85*a* on each of hubs 85 at the opposite ends of manifold member 78. Each stationary piston member 87 is provided on its outer cylindrical periphery with an annular recessed groove 89 in which there is mounted any suitable commercially available annular sealing ring (or rings) shown at 90**. Each stationary piston member 87 also is provided on its outer cylindrical periphery with an annular flanged section 91 which has an annular planar end 92 disposed perpendicular to the longitudinal axis of cylindrical stationary piston 87. The axis of stationary piston 87 is coincident with the above-described axes of assembly cylinder 62, ring 80, and manifold member 78.

Cylindrical axial plungers 64 and 66 in each of mold core assemblies 42 and 44 are of like configuration excepting that axial plungers 66 are longer than axial plungers 64 in the direction of their longitudinal axis. Also axial plungers 64 and 66 are mounted on their respective coacting stationary pistons 87 in the same way and operate in relation thereto in like manner as herein described. Each axial plunger 64 is provided with an internal hollow cylindrical portion 93, and each axial plunger 66 is provided with an internal hollow cylindrical portion 93*a* which is like said portion 93 of axial plunger 64 excepting that 93*a* is longer than 93. The open end of each of cylindrical portions 93 and 93*a* of axial plungers 64 and 66 is provided with an internal cylindrical step section 94 which in turn is provided with an internally recessed annular groove 95 near the open ends of hollow cylindrical portions 93 and 93*a* of axial plungers 64 and 66 respectively. An annular ring 96 is mounted in internally stepped section 94 of each of axial plungers 64 and 66; and each said annular ring 96 is secured with one flat side thereof abutting annular face surface 92 on the end of cylinder flange portion 91 of each stationary piston 87, by means of retaining rings 97 disposed in said annular grooves 95. Each of said annular rings 96 is provided with a groove 98 on its exterior cylindrical surface and with a groove 99 on its interior cylindrical surface 97; and suitable commercially available sealing rings 100 are mounted in each of said grooves 98 and 99.

Annular grooves 102 are provided adjacent opposite ends of each assembly cylinder 62 in the interior cylindrical surface 103 of cylinder 62. Sweeper gaskets 104 are provided in each of said grooves 102 and each gasket engages the exterior cylindrical surface of associated axial plungers 64 and 66 so that when plungers 64 and 66 have been extended and exposed to CM mix 70 as shown in FIG. 4, and said plungers are then retracted to inside the mold cores 49 as shown in FIG. 6, the sweeper gaskets 104 will wipe particles of CM mix off the cylindrical exteriors of plungers 64 and 66.

At least the exterior of axial plungers 64 and 66 including their respective ends 65 and 67 may be coated with a sufficient thickness of a commercially available hard and abrasion-resistant chromium-steel alloy or like suitable material.

Referring now to FIGS. 9 and 12, each of like manifold members 78 of mold core assemblies 42 and 44 is provided with a pair of drilled holes 108 and 109 extending longitudinally through manifold member 78 from end to end, spaced from and substantially parallel to the axis of member 78. Each manifold member 78 is also provided with a pair of drilled holes 110 and 112 extending inwardly from the outer periphery of manifold member 78 so that hole 110 intersects said longitudinally extending hole 108 in manifold member 78, and hole 112 intersects longitudinally extending hole 109 in manifold member 78. Also each manifold member 78 is provided near each opposite end thereof with a pair of drilled holes 114 and 116 extending inward from the outer periphery of manifold member 78 and intersecting said longitudinally extending hole 108 in each manifold member 78. Also, the opposite ends of hole 108 in each manifold member 78 (but not hole 109 thereof) are sealed by plugs shown at 113 in mold core assembly 42 at the left of FIG. 9. Referring especially now to mold core assembly 42 at the left of FIG. 9, said holes 114 and 116 are located adjacent each of stationary pistons 87 at the opposite ends of manifold member 78 so that compressed air will pass from end-sealed manifold hole 108 through holes 114 and 116 to the sealed-off space 118 between the stationary piston 87 and the sealed annular ring 96 secured to each of axial plungers 64 and 66. As a result, compressed air injected into the sealed-off spaces 118 via manifold hole 108 and said holes 114 and 116 will apply positive force to axial plungers 64 and 66 causing them to move from the extended position shown in mold core assembly 42 at the left of FIG. 9 to the fully retracted position of plungers 64 and 66 shown in the mold core assembly 44 at the right of FIG. 9. To cause plungers 64 and 66 to extend, compressed air injected via manifold member hole 109 through the open ends thereof into spaces 117 and 119 of plungers 64 and 66 will apply positive force to the axial plungers 64 and 66 causing them to move from retracted position shown in mold core assembly 44 at the right in FIG. 9 to the fully extended position of plungers 64 and 66 shown in the mold core assembly 42 illustrated at the left of FIG. 9.

Still referring particularly to FIGS. 13 and 12, a top portion of ring 80 is milled to provide a recessed cavity 120 having a bottom surface 122 which will be disposed substantially horizontally when the plungers sub-assembly 45 is assembled in mold core 49. A pair of holes 110*a* and 112*a* are drilled in ring 80 inwardly from surface 122 of recess 120 in ring 80 so that when each ring 80 is assembled on its associated manifold member 78, said hole 110*a* in ring 80 is a continuation of hole 110 in member 78 and said hole 112*a* in ring 80 is a continuation of hole 112 in member 78. Each cylindrical assembly sleeve 62 is provided with drilled holes 110*b* and 112*b* which are respectively substantially axially aligned with said holes 110+110*a* and 112+112*a*. The top wall 55 of each mold core 49 is provided with drilled holes 110*c* and 112*c* which are disposed substantially vertically above holes 110*b* and 110*c* in cylindrical assembly sleeve 62. It is noted that holes 110*c* and 112*c* are located on opposite sides of core bar 72.

An air coupling block 124 is welded or otherwise secured to core bar 72 above holes 110*c* and 112*c* in mold core 49 of mold core assembly 42; and an air coupling block 126 is similarly secured to core bar 72 above holes 110*c* and 112*c* in mold core 49 of mold core assembly 42. Metal tubes 128 of suitable material and size for conducting compressed air are disposed on opposite sides of core bar 72 and tubes 28 are connected at one end by press-fit or in other suitable manner to air passage holes 130 and 134 drilled in air coupling blocks 124 and 126 respectively. Each of air tubes 128 extends through hole 112*c* in top plate 55 of one of mold cores 49 and through hole 110*b* in one of cylindrical assembly sleeves 62 and has its other end press-fitted in the upper enlarged portion of hole 112*a* in one of annular rings 80. The lower ends of air tubes 128 are also sealed by O-ring 129 and retainer means 131 disposed in recessed cavity 120 in ring 80 inside assembly cylinder sleeve 62. Thus compressed air fed via each coupling block 124 and 126, respectively, through its associated air tube 128 will pass through hole 110 in manifold member 78 and then via longitudinally extending hole 108 through the open ends thereof to operate axial plungers 64 and 66 so that they will extend. Similar metal tubes 132 for conducting compressed air are disposed on opposite sides of core bar 72, and tubes 132 are suitably connected at one end to air passage holes 135 and 143 drilled in each of air coupling blocks 124 and 126 respectively. Each metal tube 132 extends through a hole 110*c* in top plate 55 of each mold core 49 and hole 110*b* in associated cylindrical assembly sleeve 62; and each tube 132 has its other lower end press-fitted in the upper enlarged portion of step hole 110*a* in annular ring 80. The lower ends of each of air tubes 132 are also sealed by an O-ring (like O-ring 129) and said retainer means 131 disposed in recessed cavity 120 in ring 80 inside assembly cylinder sleeve 62. Thus compressed air fed via air coupling blocks 124 and 126 respectively through tubes 132 will pass through hole 110 into longitudinally extending end-plugged hole 108 of each manifold member 78 to operate axial plungers 64 and 66 so that they will retract as elsewhere herein explained. Retainer means 131 for O-rings 129 is a plate secured in recess 120 in ring 80 by a plurality of screws (not shown) which are threaded into holes extending inwardly into ring 80 from the bottom of 122 of recess 120 (holes not shown).

Air coupling block 124 is provided with another drilled hole 136 perpendicular to and intersecting hole 130 therein and also extending through to the other side of block 124. Air coupling block 124 is provided with still another hole 138 drilled therein perpendicular to and intersecting hole 135 in block 124 and also extending to the other side of the block 124. The other air coupling block 126 is provided with a hole 140 drilled therein perpendicular to and intersecting hole 134 to form an air conduit therewith. Air coupling block 126 is also provided with another hole 142 drilled therein extending normal to and intersecting the hole 143 drilled in block 126 to provide an air conduit therethrough. An air tube 148 is similarly suitably connected at opposite ends thereof to the air hole 136 drilled in air coupling block 124 and to the air hole 140 drilled in air coupling block 126. Also, an air tube 150 is suitably connected at one of its ends to the other end of hole 138 in air coupling block 124, and the opposite end of air tube 150 is suitably connected to air hole 142 in air coupling block 126. Air tubing 144 is connected to a source of constant pressure compressed air through a suitable commercially available three-way valve or like suitable means 48*v*, and is press-fit or otherwise suitably connected at one end in hole 136 in air coupling block 124. Air tube 146 is similarly connected to a constant pressure compressed air source and suitable commercially available three-way valve or like suitable means 48*v*, and is press-fit or otherwise suitably connected in the slightly enlarged end of hole 138 in air coupling block 124.

When the compressed air control means such as a three-way valve 48*v* is operated to provide compressed air to conduit 144 from a conventional compressed air source by suitable conventional means like a three-way valve, the compressed air will be supplied at the same time to both axial plunger sub-assemblies 45 of mold core assemblies 42 and 44 since they are connected in parallel to the compressed air source via conduit 144 whereby the plungers 64 and 66 of mold core assemblies 42 and 44 will simultaneously be extended outwardly to the position shown in mold core assembly 42 at the left of FIG. 9 and in FIGS. 3–5. More specifically, compressed air from conduit 144 passes to conduit 128 of mold core assembly 42 and simultaneously to conduit 128 of mold core assembly 44 via tubing 148 interconnecting air couplings 124 and 126. The compressed air passes simultaneously via tubes 128 to and through holes 112*a* in ring 80 and 112 in manifold 78 and then through longitudinally extending hole 109 in manifold 78 and out through the open ends of hole 109 into the inside portions 117 and 119 of axial plungers 64 and 66, respectively, causing said plungers to extend under the positive force exerted thereon by compressed air in the manner described. When the compressed air control means such as a three-way valve 48*v* is alternatively operated to provide compressed air to conduit 146, compressed air will be provided at the same time to each of mold core assemblies 42 and 44 simultaneously. In this case, the compressed air from conduit 146 passes via air coupling block 124 to and through tube 132 to mold core assembly 42, while compressed air simultaneously passes from conduit 146 via air coupling 126 through tubing 150 and air coupling 126 and through air tubing 132 to mold core assembly 44, whereby plungers 64 and 66 will simultaneously be retracted to the position shown in mold core assembly at the right in FIG. 9 and in FIG. 6. More specifically, the compressed air simultaneously provided through tubing 132 to each of mold core assemblies 42 and 44 passes through holes 110*a* in ring 80 and hole 110 in manifold member 78 and then into and through the end-plugged longitudinally extending hole 108 in manifold member 78, and thence through laterally extending passages 114 and 116 into the spaces 118 behind stationary pistons 87 so as to apply a force which positively and simultaneously retracts all of plungers 64 and 66 in both of the mold core assemblies 42 and 44.

Referring to FIGS. 9 and 13, the bottom portion of each assembly sleeve 62 and annular ring 80 in each of mold core assemblies 42 and 44 is provided with a pair of communicating slots shown at 152 so as to provide an air passage from the inside to the outside of assembly sleeve 62 in communication with the inner portions of axial plungers 64 and 66 disposed on opposite sides of ring 80 in each of mold core assemblies 42 and 44. Such slots 152 provide passages for venting of air from inside sleeve 62 and relief of pressure when the axial plungers are operated as herein explained to cause axial plungers 64 and 66 to move from the extended to the retracted position.

A hole 154 is drilled in the cylindrical wall of each of the longer axial plungers 66 and a smaller vent hole 156 is provided at the end of hole 154 extending to the outer end surface 67 of each of plungers 66. Like holes 154*a* and 156*a* are drilled in the cylindrical wall of each of the shorter axial plungers 64. In each of mold core assemblies 42 and 44, a cylindrical pin 158 is mounted at one end on annular support ring 80 in any suitable manner, e.g., by the end of pin 158 being threaded and secured in a threaded hole in ring 80 (see mold core assembly 42 at the left of FIG. 9). The axis of pin 158 is substantially perpendicular to ring 80 and also is coincident with the axis of holes 154,156; and the diameter of pin 158 is less than the inside diameter of hole 154. Thus, air may be vented through holes 154,156 when axial plunger 66 is retracted from the extended position shown in mold core assembly 42 at the left of FIG. 9 to the retracted position shown in mold core assembly 44 at the right of FIG. 9. The pins 158 have an outer diameter also less than the inner diameter of outer holes 156 at the ends of holes 154 in axial plungers 66 so that the ends of pins 158 will extend into holes 156 and thereby clear from said holes any particles of CM mix 70 which may have entered holes 156 during any of the biaxial CM block casting steps described above. Similar but shorter pins 158*a* are similarly mounted on opposite sides of ring 80 in each of mold core assemblies 42 and 44, and pins 158*a* extend into apertures 154*a* in the sides of axial plungers 64, with the ends of pins 158*a* extending into end apertures 156*a* when the shorter axial plungers 64 are fully retracted. Pins 158*a* coact with holes 154*a*,156*a* in the shorter axial plungers 64 to vent air when plungers 64 are retracted and also to displace any particles of CM mix 70 which may become lodged in the end holes 156*a*, in like manner as explained above with reference to longer pins 158 and holes 154,156 of longer axial plungers 66.

After the CM mix 70 is compressed and vibrated to form the CM block 30*b* as shown in FIG. 5 and retraction of plungers 64 and 66 is started as shown in FIG. 6, there will be resultant substantial negative pressure and vacuum effect between (i) the ends 67 of longer axial plungers 66 and the sides 54 of the mold box 52 and (ii) between the two abutting ends 65 of the shorter axial plungers 64. The holes 154,156 in the longer axial plungers 66 and the holes 154*a*,156*a* in the shorter axial plungers 64 serve to break such negative pressure and vacuum effect between the ends 67 of plungers 66 and mold walls 54 and between the abutting ends 65 of the plungers 64 when said plungers start to retract as illustrated in FIG. 6. Also, when the plungers 64 and 66 are being fully retracted after completion of the step shown in FIG. 6 and before start of the step shown in FIG. 7, the ends of pins 158 and 158*a* will respectively extend into holes 156 of plungers 66 and into holes 156*a* of plungers 64 to dislodge particles of CM mix therefrom and thereby clean the ends of holes 154,156 and 154*a*,156*a*.

Each of biaxial plunger sub-assemblies 45 of each of mold core assemblies 42 and 44 is mounted in its associated mold core 49 by a bracket 160 having a relatively elongated main section 162 and two legs 164 extending substantially perpendicular from section 162 as will be apparent from said Figures. The elongated portion 162 of bracket 160 is secured to a bottom portion of assembly sleeve 62 by a pair of screws 166 extending into threaded apertures 168 in the main portion 162 of bracket 160. Each leg 164 of bracket 160 is provided with a threaded aperture 170 which receives a threaded screw member 172 which is provided with a slot 174 (or equivalent means) to enable turning of screw 172 in threaded aperture 170. A nut 176 is screwed onto the threads of screw 172 on the inside of bracket legs 164 as shown in said Figures. After the biaxial plunger sub-assemblies 45 are mounted in apertures 59 in the walls 53 and 53*a* of mold core assemblies 42 and 44, respectively, bracket 160 is secured to the assembly sleeve 62 by means of screws 166 threaded into holes 168, and then the screws 172 plus nuts 176 are adjusted in relation to bracket legs 164 and side walls 53 and 53*a* of the mold core 49 so as to finalize the location of each biaxial plunger sub-assembly 45 in relation to side walls 53 and 53*a* of mold cores 49 and to secure each bracket 160 firmly in relation to its mold core 49. Each respective biaxial plunger sub-assemblies 45 is thus secured by like bracket means in like manner to the associated mold core 49 of each mold core assembly 42 and 44. It is noted that the slots indicated at 152 cut in the underside of each of assembly cylinders 62 and the lower opposite sides of each annular ring 80 will extend laterally beyond the sides of the mounting bracket 160 as shown particularly in FIG. 13 so as to permit the venting of air from the inside of each cylindrical sleeve 62 to relieve pressure therefrom particularly when the axial plungers 64 and 66 are retracted, as above discussed.

Reference is now made particularly to FIGS. 9–13. Suitable air tubing of metal or the like generally indicated at 178*c* is connected to the compressed air source by means of a suitable commercially available pressure reduction device 48*v* whereby air is fed at a low pressure through tubing 178*c* and via air couplings 124 and 126 to and through tubing 178 to each of mold core assemblies 42 and 44. The flexible tubing 178 suitably connected to and extending from the outlet end of air couplings 124 and 126 is passed through an aperture 180 in the top end surfaces 55 of each of mold cores 49, is "snaked" around the assembly cylinder 62 in each of mold core assemblies 42 and 44, and is connected in series to a pair of nipples 184 which are threaded in apertures in each assembly cylinder 62 so that air will pass through flexible tubing 178 to the inside of cylinders 62 of each mold core assembly 42 and 44. See especially mold core assembly 44 at the right in FIG. 9. Flexible tubing 178 is connected by nipples 184 in like manner to both mold core assemblies 42 and 44 and operation thereof is the same for both assemblies 42 and 44. When the axial plungers 64 and 66 of the mold core assemblies 42 and 44 are retracted during biaxial CM block casting process, it is necessary to assure that all axial plungers 64 and 66 are fully retracted so that all parts thereof are totally disposed inside of walls 53 and 53*a* of the mold cores 49 before the CM block 30*b* is stripped from the mold 52 by the compression/stripper shoe. The nipples 184 connected to flexible air lines 178 are located so that the aperture in each nipple 184 extending to the inside of assembly sleeve 62 will be blocked off by the "inner ends" of axial plungers 64 and 66 when those plungers are in fully retracted position, as shown particularly in mold core assembly 44 at the right of FIG. 9. The nipples 184 in cooperation with their associated air lines 178 serve as "air sensors" for axial plungers 64 and 66 in each of mold core assemblies 42 and 44 to determine whether each and all said plungers 64 and 66 are fully retracted to inside mold core 49 as shown in mold core assembly 44 at the right of FIG. 9. That is because if all said axial plungers 64 and 66 are fully retracted there will result a sufficient predetermined back pressure (e.g., 15 psi or the like) which is measured by a suitable commercially available pressure gauge 48*g* that is connected to the low pressure line 178*c* on the input side of air coupling 124 and is mounted on CM casting machine 48 where it can be conveniently observed by the machine operator. Thus, if such back pressure via nipples 184 and air lines 178,178*a* is above a predetermined psi level, that indicates that the axial plungers 64 and 66 are fully retracted so that the CM block casting operation can be continued. On the other hand, if all the axial plungers 64 and 66 are not fully retracted, air will pass via air lines 178 through nipples 184 into assembly cylinders 62 and out of vents 152 in the underside thereof; and this will cause a low and insufficient back pressure reading at the pressure gauge 48*g* in line 178*c* on the input side of air coupling 124, thereby indicating that one or more of axial plungers 64 and 66 are not sufficiently retracted. Further, such "air sensor" arrangement for determining full retraction of plungers 64 and 66 by means of nipples 184 and air lines 178,178*a* is also used (i) to discontinue operation of the casting machine 48 if any axial plungers 64 and 66 are not fully retracted or (ii) to permit continued operation of the CM casting machine 48 if the axial plungers 64 and 66 are fully retracted, as further described below.

Referring to FIG. 13, the portion of conventional CM casting machine 48 shown in that drawing is made from a press-through of a photograph of a Columbia Machine Model 5 (one of many CM casting machines all utilizing analogous technology) made by Columbia Machine, Inc., located in Vancouver, Wash. ("Columbia"). This model Columbia machine makes one block at a time, at the rate of one block about every six seconds. Columbia, however, also makes similar CM casting machines operating in similar manner but which can produce three, six or even 12 CM blocks at a time (a three-block casting machine is believed most commonly used in the U.S.A. CM block making industry). Such Columbia machines, exemplified by Columbia Machine Model 5, have both a manual and automatic cycle operating mode. For the automatic cycle operating mode, the casting machine has a control panel incorporating electromechanical control circuitry to operate the machine in a conventional cycle. In a conventional CM block casting process, conventional mold cores similar to cores 49 but having four planar side walls would be used in a conventional manner well known in the art. The control circuitry of casting machine provides a logic pattern for conventional CM casting whereby: (1) the compression/stripper shoe 56 is lifted upwardly above the level of the feed tray 58 and a pallet 60 is raised to form the bottom of mold 52; (2) the feed tray 58 moves in over the mold 52 below the compression/stripper shoe 56; (3) CM mix 70 is fed into the cavity of the mold 52 from the feed tray 58; (4) the feed tray 58 is laterally withdrawn from over the mold 52 permitting the compression/stripper shoe 56 to come down and compress CM mix 70 in the mold 52 as vibration of mold 52 proceeds by conventional means incorporated in CM casting machine 48; (5) the compressed CM material formed into a conventional CM block is then stripped from the cavity of the mold 52 by simultaneous downward motion of compression/stripper shoe 56 and the bottom pallet 60; (6) the compression/stripper shoe 56 returns upward past the mold cores while the newly made conventional CM block 30 is being ejected on its individual pallet 60 onto a conveyor; (7) after the compression/stripper shoe 56 moves upwardly out of and above the mold 52, the above-discussed steps (1) to (6) are then repeated to carry out the next cycle for molding the next conventional block 30 in like manner as just described above herein. Note that in such a conventional CM block casting process there is no step corresponding or analogous to that shown in FIGS. 2–6.

To use the biaxial casting apparatus and process disclosed herein in a conventional block casting machine 48, there is provided a suitable commercially available electromechanical control means **48*c* for the suitable commercially available three-way valve 48*v* as part of the compressed air control means so as to alternately supply compressed air from a compressed air source to conduit 144 whereby such compressed air passing through tubing 128 to manifold hole 109 will cause axial plungers 64 and 66 in both mold core assemblies 42 and 44 to extend simultaneously. Also, said electromechanical compressed air control means 48*c* is caused to alternatively operate the three-way valve 48*v* to alternately supply compressed air to conduit 146 and thus via tubes 132 to hole 108 in manifold 78 so as to simultaneously cause retracting of all plungers 64 and 66 in mold core assemblies 42 and 44. The electromechanical control means 48*c* for the three-way valve 48*v* (or other equivalent conventional means) for alternately feeding compressed air from the source to input line 144 (to extend all axial plungers 64 and 66) or to input line 146 (to retract all axial plungers 64 and 66) are appropriately tapped into the electrical control circuitry in the control box 48*c* of the machine 48 to modify the machine's automatic operations logic pattern so as to modify the machine's typical above-discussed conventional molding cycle to the biaxial CM casting cycle shown in FIGS. 2–8 and fully described above. Thus the electromechanical means for controlling the three-way valve (or other equivalent means) is tapped into the control circuitry of casting machine 48 to modify its logic whereby: (a) compressed air is fed to line 146 to simultaneously positively retract axial plungers 64 and 66 in both mold core assemblies 42 and 44 as the compression/stripper shoe 56 is raised to above the feed tray 58 and the pallet mold 60 is raised to form the bottom of the mold 52; (b) compressed air is then supplied by activation of the three-way valve to input conduit 144 to cause the axial plungers 64 and 66 to be simultaneously positively extended and to remain in such extended position for the phases of the biaxial CM casting process shown and described above; (c) upon stoppage of the vibration subcycle, the three-way valve is switched to supply compressed air to input conduit 146 to cause the axial plungers 64 and 66 to move to simultaneously positively retract after the CM block 30*b* is formed, and to maintain said plungers in fully retracted position within the walls of mold cores 49 as shown in FIG. 11 before the compression/stripper shoe 56 and pallet 60 are permitted or caused to be moved downward to the bottom of the box to strip the completed CM block 30*b* from the mold 52; (d) the compression/stripper shoe 56 is raised up past the mold cores 49 and the fully retracted axial plungers 64 and 66 disposed inside the walls of mold cores 49 while the just-made CM block 30*b* is moved to a conveyor on its pallet 60 and a new pallet 60 is moved in below the mold 52 to provide a new mold bottom; and (e) the CM biaxial mold process and phases thereof shown in FIGS. 2–8** is thereafter repeated.

The portion **178*a* of the low pressure third air line 178,178*a* which extends from the input side of the air coupling 124 is connected to a suitable commercially available pressure gauge 48*g* to indicate to the machine controls whether the back pressure of air at nipples 184 and in lines 178,178*a* is (1) equal to or greater than a predetermined minimum back pressure (e.g., 15 psi), thereby indicating machine logic circuitry that the axial plungers 64 and 66 are fully retracted, or (2) is below such predetermined minimum back pressure, thereby indicating machine logic that one or more of axial plungers 64 and 66 are not fully retracted. In the latter case (2), the machine logic stops the machine 48. The pressure gauge is connected to a pressure-operated switch responsive to gauge movement and which switch is in turn tapped into the control circuitry of the casting machine 48 to operate as a "go-no go" addition to the machine's control system so that after a CM block 30*b* has been formed as shown in FIG. 1, the machine will not proceed with stripping of the block 30*b* and removal of the pallet 60 unless all axial plungers 64 and 66 move to fully retracted position as shown in FIG. 7** and in assembly 44 at the right of FIG. 9. If all axial plungers 64 and 66 are thus fully retracted the thus-modified machine 48 will proceed with the next phase of the block casting cycle involving removal of the CM block 30*b* as shown in FIG. 7, and then automatically proceed with additional CM block making cycles as shown in FIGS. 2–8 as hereinabove described. However, if all axial plungers 64 and 66 are not fully retracted when they should be, the thus-modified machine 48 will not proceed with the next phase of the biaxial CM casting process; the operator will then determine and fix the problem. Preferably, visual indicators respectively wired to the plungers provide indication to the operator as to which of the plungers is jammed.

The operating program and logic governing the conventional block-making automatic cycle of machine 48 exemplified by Columbia Machine Model 5 is shown in Columbia drawing No. D-328-30-52-1 titled "Control Schematic, Model 5 Block Machine, Stepper Controlled Oscillation". The aforementioned electromechanical controls for operating the three-way valve 48*v* for alternately supplying air to input conduit 144 to extend all axial plungers 64 and 66 or to input conduit 146 to retract all axial plungers 64 and 66, and the aforementioned pressure-operated switch connected to low pressure input line 178*c* are suitably tapped into the control arrangement shown in said Columbia drawing to modify the logic and operating program governing conventional automatic operation of the casting machine so as to perform automatic operation of the biaxial CM casting process of FIGS. 2–8 as herein disclosed.

As will be apparent to one skilled in the art in light of the disclosure and detailed explanation herein of the biaxial CM casting apparatus and biaxial CM casting method of the present inventions, although the same are explained by way of example as used in a Columbia Machine Model 5 casting machine having only one mold, such new biaxial casting apparatus can be installed in like manner in commercially available machines having three molds, six molds or any number of molds by using for such multiple molds an equal number of mold core systems generally indicated at 41 including mold core assemblies 42 and 44 and core bar and mounting assembly 46.

While the foregoing biaxial casting apparatus functions satisfactorily in the aforementioned intended manner, extensive experimental use has uncovered a number of problems. For example, the feature of single wiping seals 102 between the outer periphery of the plunger 106 and the inner periphery of sleeve 62 may not function satisfactorily, under certain operating conditions, in preventing dirt and CM material from entering the interior of the sleeve along the outer periphery of the plunger. Upon intrusion into the plunger interior (i.e., the space formed between the end face of the plunger and opposing end face of ring 80), this dirt can cause plunger jamming and can also interfere with and cause abrasion of various working parts such as abrasion of manifold 78 and pin 158. Dirt and dust can also enter the sleeve interior through vents 152.

It is accordingly one object of the present invention to prevent entry of dirt and CM material into the interior of the critical parts (i.e., parts which may jam or malfunction) of the mold core assembly.

Another object of the invention is to prevent abrasion of the working parts within the sleeve of the mold core assembly, such as abrasion of the manifold exterior surface in sliding sealing contact with the piston head of the plungers as well as abrasion of the pin movably disposed within the vacuum breaking passage of the plungers.

Another object of the invention is to avoid plunger jamming by preventing dirt from entering the interior of the sleeve between the outer periphery of the plunger and the inner periphery of the sleeve in sliding sealing contact with the plunger outer periphery.

Still another object of the invention is to prevent dirt and dust from entering the sleeve interior through the vents formed in the bottom of the sleeve.

During retraction of the plungers, air is supplied only through passage 154 and hole 156 to break the vacuum between the outer periphery of the plunger and the CM material in suction contact therewith. Since only a limited amount of air can be supplied through passage 154 and hole 156, the plunger reaction times are slow which reduces production output since the formed CM block cannot be stripped from the mold until the plungers completely retract to within the periphery of the mold cores. Plunger retraction is also prolonged due to the volume of air within the sleeve interior which must be displaced by the retracting plunger and the inadequate venting of such air through vents 152.

Still another object of the invention is to improve venting conditions within the sleeve interior so as to provide depressurization within the mold core to improve the plunger reaction times and provide for earlier release of the plungers from the mold cavities.

In the foregoing biaxial CM casting apparatus, the manifold 78 has a relatively large outer diameter in comparison with the diameter of the piston head 87 or the outer diameter of the plunger. In the foregoing apparatus, the disclosed ratio between the outer diameter of manifold 78 and the outer diameter of plunger 106 is approximately 1:2. This large diameter manifold member 78 reduces the effective surface area of piston 87 in the retraction mode of the plungers which therefore results in reduced retraction forces and prolonged retraction times, not to mention the additional weight added to the overall mold core system by the larger diameter manifolds.

Another object of the invention is to increase the retraction force utilized to retract the plungers to within the mold core peripheries and thereby improve retraction times.

Yet another object is to improve retraction times without increasing the pressure of air supplied through the mold core to extend and retract the pistons, without the use of larger size and more expensive compressors.

Another object of the invention is to reduce the overall weight of the biaxial mold core assemblies.

In the disclosed embodiment, the plungers are operated to extend through their entire stroke so as to ensure contact between their end faces 67 and the inner surfaces of the mold box walls which thereby cause openings 40 to extend entirely through the CM block walls or webs. The disclosed arrangement precludes the formation of indentations (which define "knock-outs") of reduced thickness in relation to the CM block walls or webs. The employment of knock-outs is desirable to enable the user to selectively form openings in different walls and/or webs of the CM block depending upon the manner in which the block is to be used during construction as will be described more fully below. As used herein, "knockouts" are depressions formed in the wall or web of the block which correspond in cross section to the cross section of the plunger.

Another object of the invention is to selectively control the plunger stroke so as to form knock-outs in selected walls and/or webs of the CM block during the casting process.

A further object is to form indentations on exterior faces of a CM block, for decorative or architectural relief purposes, such as by exterior placement of the plunger.

In the aforesaid mold core assembly, the core bar 72 is of solid, non-hollow construction with the pneumatic lines carried atop the core bar exposed to the working environment and thereby subject to damage. The pneumatic lines are coupled via air coupling blocks 126 to the manifold 78 within the mold core sleeves 62 via lines 128, 132 and 172 extending between the mold cores and coupling blocks. This arrangement disadvantageously increases the number of fittings necessary to communicate the source of compressed air with the manifold arrangement within the mold cores.

Another object of the present invention is to protectively shield the pneumatic lines extending from a source of compressed air to within the mold core assemblies to prevent damage to the lines as a result of exposure to a rugged and hostile environment.

Another object of the invention is to reduce the overall weight of the biaxial mold core assemblies by reducing the weight of the core bar.

Still a further object of the invention is to reduce the number of pneumatic fittings and therefore reduce the cost of the biaxial mold core assemblies and the possibility of disconnection at the fittings.

Still a further object is to improve the venting of pressurized air within the cartridge sleeves of the mold core assemblies by creating a venting path through the hollow core bar in communication with the interior of the mold core sleeves through the venting slots.

As a result of the extensive testing and experimentation of a prototype of the biaxial concrete casting apparatus embodying the foregoing invention, it was discovered that the geometry of the biaxial block imposed new flow constraints on the material being fed into the mold box, and consequently, the process was found to be sensitive to aggregate type and mix design of the CM material, parameters which are not easy to control as demonstrated by the wide variations in gradation and flow characteristics of block mixes across the country. For example, flow cracks were by far the most damaging and obvious quality defects encountered in the manufacture of early biaxial blocks, particularly as applicable to the use of lightweight aggregates in the Southern United States. These cracks were visible at around 4 and 8 o'clock around the biaxial opening, evidencing the difficulty encountered by the material to flow under the biaxial plunger. Another problem is transverse bulging of the blocks which results when material flow was enhanced through the increase of the water content in the mix, or the addition of flow admixtures, in order to minimize the cracks around the lower hemisphere of the biaxial hole. In these cases, the "green" product becomes more plastic, and is deformed by the thrusting forces imparted horizontally from the arching action of the material above the biaxial hole.

Yet another object of the present invention is to reduce flow cracks within the finished cast product as well as transverse bulging.

Still another object of the invention is to reduce flow cracks and minimize transverse bulging by modifying the cross-sectional plunger shape to increase the vertical flow channels on either side of the plunger and thereby simultaneously buttress the arch above the biaxial opening against the horizontal thrust of the suspended material.

As mentioned above, the strike off bar is operated to remove excess CM material projecting above the top end walls 55 of the mold core assemblies prior to compression and stripping of the block with compression stripper shoe 56 as depicted in FIGS. 3–6. Since the lower scraping edge of the strike off bar is an uninterrupted straight edge, extensive experimentation has revealed that, due to the biaxial geometry within the mold cavities (i.e, around the extended plungers), insufficient CM material fills the cavities beneath the plungers. Voids are therefore created.

Yet another object of the present invention is to ensure that sufficient concrete material fills the cavities to prevent voids.

Still another object of the invention is to modify the scraping edge of the strike off bar so that additional CM material extends upwardly above the top end wall of the mold cores following removal of excess material with the strike off bar whereby the additional material is thereafter compacted into the mold cavities by the compression/stripper shoe to fill any voids within the cavity, particularly beneath the plungers.

One of the most important features of my above-described prior invention relates to the logic and related mechanism for ensuring that the plungers completely retract within the periphery of the mold cores prior to stripping of a cast CM block from the mold with the compression/stripper shoe. In my prior invention, a nipple 184 mounted adjacent housing sleeve 62 is supplied with low pressure air through conduits 178 in a position to be blocked by the exterior surface of the plunger in the fully retracted position. In the fully retracted position of a plunger 66, the nipple 184 acts as an air sensor since the resulting blockage of the nipple by the fully retracted plunger raises the pressure within line 178 which is sensed by the pressure gauge/switch connected to the low pressure line. If the orifice of nipple 184 remains open (i.e., the plunger has not fully retracted to block the orifice), this pressure condition is sensed by the pressure gauge/switch to prevent the compression/stripper shoe from stripping the block from the mold as aforesaid.

In my prior invention, low pressure air is supplied to the low pressure line 178 through the same compressor supplying pressurized air to the lines 144,146 used to extend and retract the pistons. By using the same compressor and motor, it was discovered that drift (i.e., pressure fluctuations) necessitated daily recalibration of the pressure gauge so as to ensure precise monitoring of low pressure and high pressure conditions within predetermined constant pressure ranges. Failure to recalibrate on a daily basis resulted in unreliable operation of the foregoing fail-safe system.

Another object of the invention is to improve the operation of the fail-safe system for determining whether the plungers have completely retracted into the mold cores.

SUMMARY OF THE INVENTION

A biaxial casting apparatus for making a concrete masonry or CM block including at least one face shell comprises a cartridge containing at least one movable plunger adapted to project laterally from the cartridge into an extended position. The cartridge is mounted such that the plunger projects into a mold cavity of a mold box along an axis transverse to a side wall of the mold box. A control arrangement selectively extends and retracts the plunger.

In one embodiment, a biaxial casting apparatus for making a concrete masonry or CM block including at least one face shell, in accordance with the present invention, is adapted to be disposed in the mold of a CM casting machine with the mold including a mold box having side wall means and a movable bottom. The apparatus comprises at least one mold core forming a mold cavity with the side walls, and at least one plunger projecting laterally outwardly from the mold core side walls into the mold cavity along an axis transverse to the side walls during selected phases of using the apparatus in casting a concrete masonry block. A control arrangement senses full retraction of the plunger from the mold cavity to thereby enable prevention of removal of the block from the mold in response to failure of the plunger to fully retract as sensed by the sensing means. In accordance with the invention, the sensing means arrangement is a nipple communicating with the interior of the mold core and including an orifice adapted to be blocked by the plunger in its fully retracted mode and is otherwise open to the mold core interior. Low pressure air is supplied to the interior through the orifice by means of a dedicated compressor connected to the orifice through a pressure regulator and a pressure switch. The pressure regulator assures a supply of substantially constant low pressure air to the orifice. The pressure switch is connected to an electrical sensing circuit determining whether the plunger has fully retracted by monitoring the change in differential pressure occurring when the orifice is either open or fully blocked by the completely retracted plunger.

The dedicated compressor is preferably connected to the orifice through an accumulating tank which is directly supplied with pressurized air by the dedicated compressor with a pressure regulator maintaining the supply of air to the orifice at a substantially constant pressure. With the foregoing arrangement, the problem of drift caused by using the same compressor supplying air to the plungers (wherein air is split to the pressure gauge) is advantageously avoided.

As an alternative to the differential air pressure sensors discussed above, other types of sensors may be employed such as electrical micro-switches, fiber-optic sensors, solid-state proximity sensors as well as other sensing arrangements as may occur to one of ordinary skill from a review of this application.

To prevent entry of dirt and liquid CM material into the interior of the mold core assembly by seepage between the exterior periphery of the plunger and the inner periphery of the cylindrical mounting sleeve, a pair of wiping seals are disposed in the inner periphery of the sleeve in sliding sealing contact with the plunger exterior periphery. Between these seals, the sleeve is provided with a slot into which is loosely disposed an over-size wiper ring having an inner diameter greater than the outer diameter of the exterior periphery of the plunger. The natural vibratory movement of the mold core assembly causes the over-size wiper ring to vibrate into and out of contact with the plunger periphery. Thereby, any dirt or liquid CM material leaking past the outer seal during retraction of the plunger periphery is knocked from the plunger periphery before reaching the second or inner seal. An open slot in the cylindrical sleeve enables the dirt and liquid CM material dislodged from the plunger periphery by the vibrating ring to drop down into a bottom portion of the mold core assembly where it is periodically removed from the assembly during routine maintenance.

To prevent dirt and liquid CM material from entering the interior of the mold core assembly through the vacuum breaking passage containing the pin, a seal is sealingly disposed around the pin and in sealing contact with the vacuum breaking passage and chamber.

To provide additional venting air through the vacuum breaking passage from the interior of the mold core assembly, an annular relief chamber is formed in the side wall of the plunger in communication with the vacuum breaking passage and the mold core interior. An annular air filter is mounted within the relief chamber to prevent entry of dirt and CM material into the mold core interior through the vacuum breaking passage.

To prevent dirt and dust from entering the mold core interior through the vents provided in the bottom portions of the mold core assembly, an air filter is installed in the open bottom of the mold core between the planar side walls thereof.

The manifold slidably carrying the plungers at opposite ends thereof is preferably formed to have a diametral ratio of about 1:3 relative to the outer diameter of the plunger. This diametral ratio reduces the weight of the mold core assembly and increases the surface area of the piston against which air is supplied to retract the plunger to thereby increase the retraction force under the same compressed air input force, relative to the arrangement of FIG. 9.

In accordance with another feature of the invention, stop screws are provided to limit the extension of the plungers to a predetermined distance less than their entire stroke, enabling the formation of indentations or knock-outs in walls or webs of the CM block. Controlled extension of the plungers is achieved by stop screws mounted to the manifold retaining ring and which slidably extend through the annular plunger ring into the space formed between the ring and piston within the plunger. A stop member disposed at the end of the screw engages the annular ring during extension of the plunger a predetermined distance to thereby limit the plunger movement. With such controlled movement, the outermost end face of the plunger does not contact the opposing mold box side wall during extension, enabling CM material to be disposed between the plunger end face and the opposing mold box side wall. Upon retraction of the plunger to within the periphery of the mold core, a resulting indentation is formed in the CM block wall. This indentation forms a knock-out enabling the formation of an opening in said CM block wall at the job site.

In accordance with another improvement feature of the invention, the annular ring-shaped retainer 80 is formed as a cross-shaped member to reduce the weight of the mold core assembly without sacrificing strength.

The core bar for mounting the mold core assemblies within the mold box 52, in accordance with another improvement feature of this invention, is preferably formed as a hollow member through which the air lines extend in protective isolation from the surrounding environment exterior to the mold core assemblies. The hollow core bar reduces the weight of the mold core system, avoids the use of air coupling blocks and reduces the number of fittings since the air lines extend continuously through the hollow core bar and enter into the mold core through a slot formed in the top end wall of the mold core through which slot the hollow core bar communicates with the mold core interior.

The feature of having the hollow core bar communicate with the mold core interior through the slot in the top end wall also improves venting of air into and out of the mold core interior during reciprocating movement of the plungers. This is because venting air can now be supplied into the mold core interior through the hollow core bar as well as the venting slots formed in the bottom portion of the mold core as aforesaid.

In accordance with another feature of the present invention, each plunger may be of a noncircular cross section having a width dimension (i.e., as measured in a horizontal plane perpendicular to the casting axis) which is less than its vertical length dimension. Stated differently, the piston preferably has an oblong cross section or a circular cross section with the laterally extending portions truncated to form vertical faces. These vertical faces permit additional CM material to be injected into the bottom of the mold during casting so that the CM material flows under the plungers to minimize flow cracks and transverse bulging.

Prior to compressing and stripping the cast CM block with the compression/stripper shoe, a strike-off bar is horizontally advanced into scraping contact with the top edges of the mold core assembly to remove excess CM material extending upward from the top edges. In accordance with another feature of the present invention, the scraping edge of the strike-off bar is formed with indentations in vertical alignment with the cavities extending between the mold core and the mold box side walls. These indentations result in a certain amount of CM material extending upward from the top end wall of the mold cores. This additional CM material is therefore available to be compressed into the mold cavities during descending movement of the compression/stripper shoe to ensure that the cavities are entirely filled with the material.

Still other objects and advantages of the present invention will become readily apparent to those skilled in this art from the following detailed description, wherein only the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

BRIEF DESCRIPTION OF THE DRAWING

FIG. 2 shows a biaxial CM mold core system according to the present invention installed in the mold box of a conventional CM casting machine; and this figure shows the mold being fed a conventional bottom pallet, with the compression/stripper shoe on its way up to provide access for the feed tray to the mold.

FIG. 14 shows a top view of the mold box and mold sides and a cross section of the mold core assemblies taken at the level of the central axes of the axial plungers of said mold core assemblies in FIG. 14.

BEST MODE FOR CARRYING OUT THE INVENTION

It is to be understood that the improvement features depicted in FIGS. 16–22 as discussed more fully below may be used either singly or in any combination with each other and my basic invention depicted in FIGS. 1–15, as will occur to one of ordinary skill in the art from a review of this application.

Figure 9:
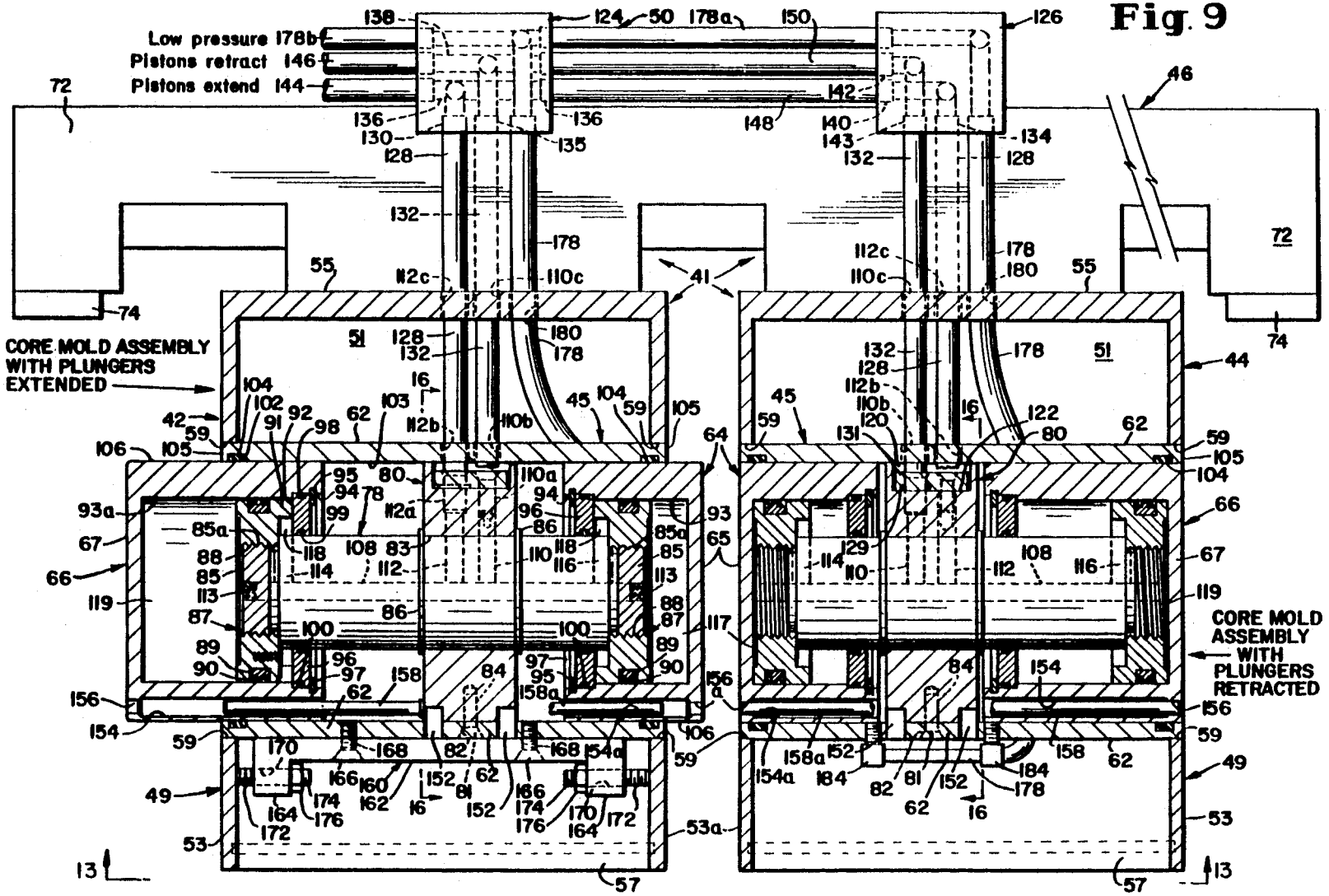
FIG. 9 is a partly cross-sectional view and partly side-elevational view of a biaxial CM mold core system plus mounting means and air conduit means for installing and operating the biaxial CM mold core system in a commercially available CM block casting machine. In the mold core on the right side of FIG. 9, the axial plungers are shown fully retracted within the mold core as they would be in phases of operation illustrated in FIGS. 2, 7 and 8 hereof. In contrast, for convenient disclosure, the mold core on the left side of FIG. 9 shows the axial plungers fully extended from the mold core as they would be in phases of operation shown in FIGS. 3, 4 and 5 hereof.
Figure 16:
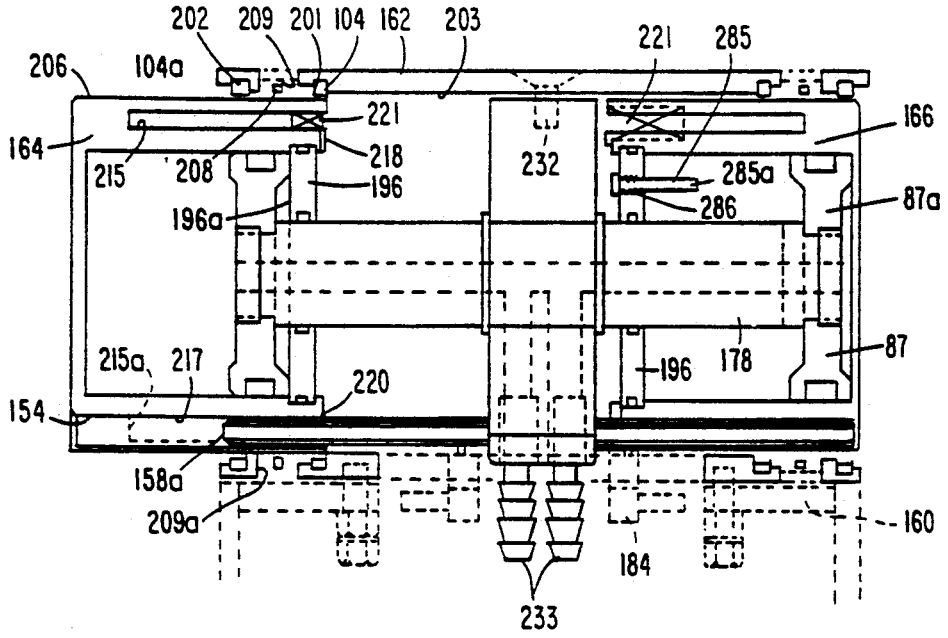
FIG. 16 is a partial sectional and partial schematic view of a modified mold core system to depict improvements to my invention.
Figure 17:
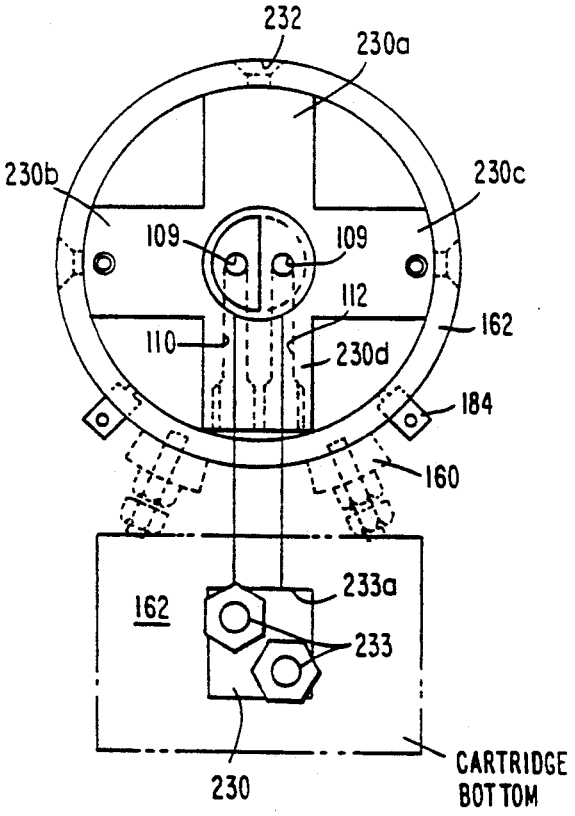
FIG. 17 is a sectional view taken along the line 17—17 of FIG. 16.

FIGS. 16 and 17 are illustrations of improvements to the axial plunger sub-assemblies 45 depicted in FIG. 9. In accordance with a first improvement feature of the present invention, the sleeve or housing cartridge 162 in which the plungers 164 and 166 are slidably disposed is formed with a pair of longitudinally spaced annular grooves 201 and 202 along the inner cylindrical surface 203 thereof at each end of the cartridge. Sweeper gaskets 104 and 104*a* are respectively disposed in the annular grooves 201,202 to create a double seal in contact with the exterior surface 206 of each plunger 164,166 to prevent entry of CM material into the cartridge or sleeve interior.

Under certain operating conditions, the single wiping seal 104 in the plunger sub-assembly of FIG. 9 can not operate satisfactorily to prevent dirt and CM material from entering the sleeve interior along the outer periphery of the plunger. Although this problem is somewhat alleviated with the double seal arrangement 104,104*a* depicted in the plunger sub-assembly of FIG. 16, it is still possible for some dirt or CM material to enter the sleeve interior along the plunger outer periphery 206. To prevent entry of CM material in the aforesaid manner, there is disposed an over-sized wiper ring 208 between the double seals 104,104*a* which ring is dimensioned to rattle and vibrate against the plunger outer periphery 206 under the natural vibratory movement of the mold core assemblies during casting. The over-size wiper ring 208, preferably made of a self-lubricating material, has an inner diameter slightly greater than the outer diameter of the plunger so that the inner annular surface encircling the plunger is capable of randomly impacting against the plunger outer surface. This action has the effect of knocking CM material or dirt leaking past the outer seal 104 in the retraction mode of the plunger from against the plunger surface. Since the over-size wiper ring is disposed in an annular groove 209 of a diameter greater than the outer diameter of the over-size wiper ring 208 and which annular groove extends axially a distance greater than the thickness of the wiper ring, the ring is capable of moving both radially and axially in a rattling vibratory contact with the plunger exterior.

The bottom wall of the annular groove 209 is formed with circumferentially spaced slots 209*a* which enable the dirt and CM material knocked loose from the plunger exterior 206 by the vibrating ring 208 to pass through the slots where this loose material may collect against an air filter 210 (FIG. 18) disposed between planar side walls of the mold cores at a bottom portion thereof.

Filter 210 prevents the entry of dirt and dust into the interior of the mold cores from the surrounding ambient environment. Filters 210 are particularly effective in preventing the entry of dirt and CM material into the mold core interior through slots 152 (not shown in FIG. 16).

Figure 15:
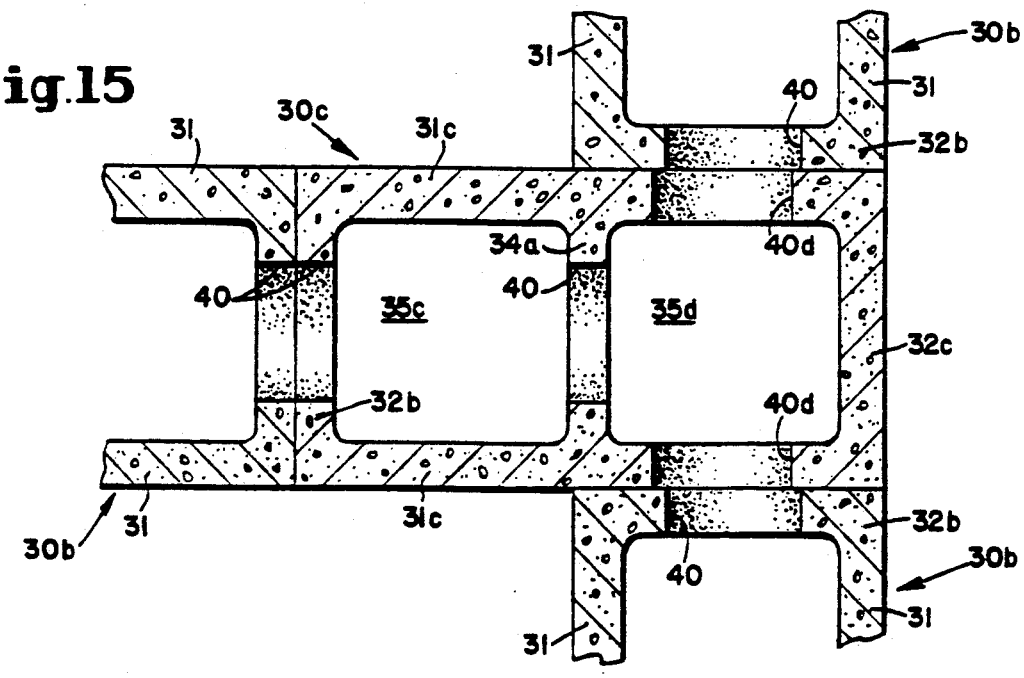
FIG. 15 shows a modified biaxially cast CM "T-block" which is generally like the above-described biaxially cast CM block but which has openings in one end web and the central web extending normal to the axis of casting, and which also has two aligned openings in the block face shells communicating with one of the twin cavities of the CM block and thus with said openings in said webs and with the other twin cavity of the T-block.
Figure 18:
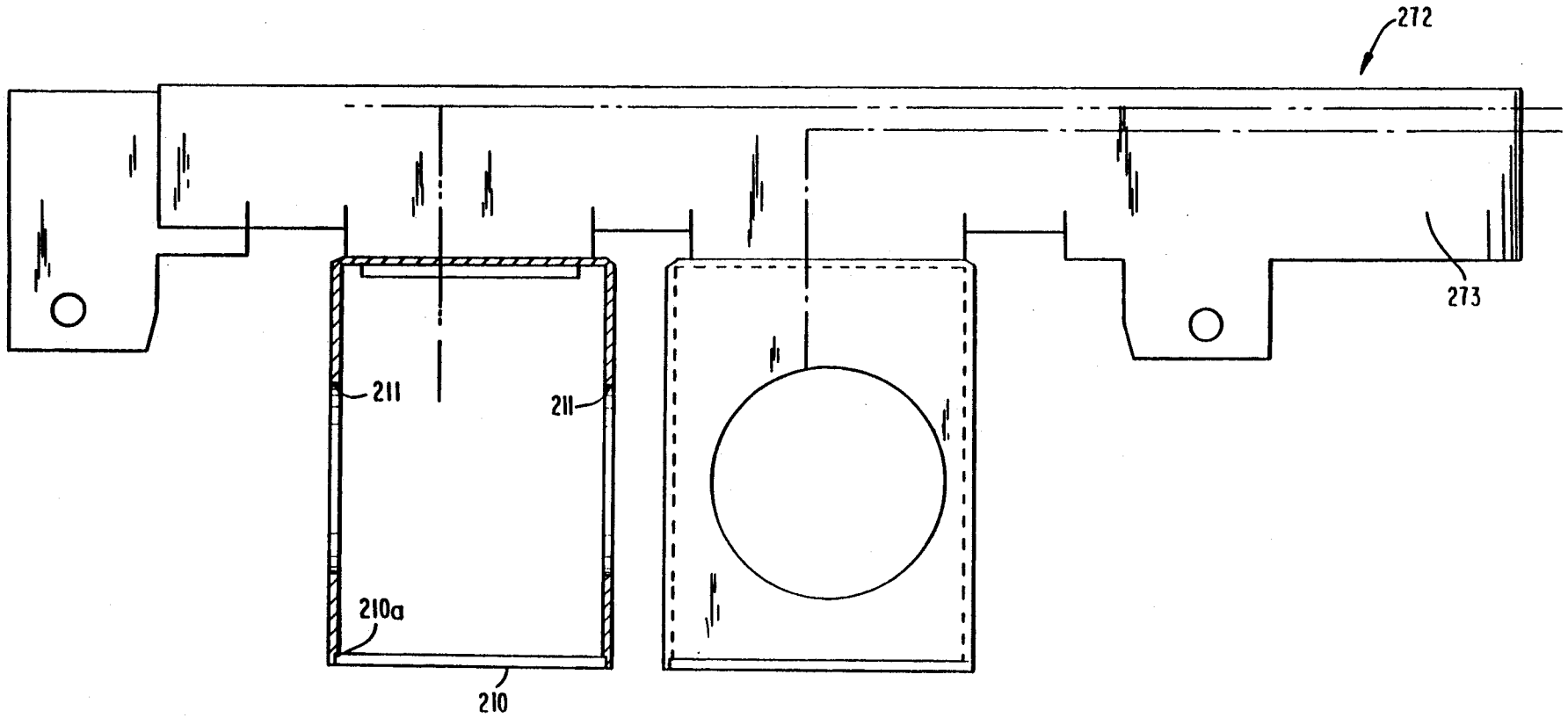
FIG. 18 is a partial sectional and schematic view of improvements to the core bar and mold core assemblies.

FIG. 18 depicts two mold cores respectively formed with a pair of coaxial openings 211 adapted to receive the plunger cartridges 162 of the type depicted in FIG. 16 or the type depicted in FIG. 9, utilizing brackets 160 to secure the cartridge within the mold core in the manner depicted in FIGS. 16 and 17. The right-hand mold core of FIG. 18 is adapted to contain a cartridge (not shown) with a pair of plungers adapted to reciprocate along an axis perpendicular to the axis of the plungers housed in the left-hand mold core. The mold core assemblies of FIG. 18 may be used, for example, to form a block as depicted in FIG. 15. The mold core arrangement of FIG. 18 corresponds to that schematically depicted in FIG. 14. The lower portions of the mold core sidewalls projecting downwardly from the cartridge are preferably formed with a step 210*a* against which air filter 210 is received.

In accordance with another improvement feature of the present invention, each plunger 164 and 166 is preferably formed with an annular relief chamber 215, as depicted in FIG. 16, which is open to the interior face 218 and terminates within the plunger sidewall at 215*a*. The vacuum-breaking air hole 154 depicted in FIGS. 9 and 16 extends through relief chamber 215. Thereby, the relief chamber advantageously increases the volume of air available to enter the passage(s) 154 from within the mold core and cartridge interior, thus insuring that the vacuum between the plunger end face 67 and the CM material or mold box walls in contact with it is quickly and easily broken as the plunger begins to retract from its extended position in the left-hand side of FIG. 16 to its retracted position shown in the right-hand side of FIG. 16. In such extended position, it will be appreciated that the increased volume of air is available to flow into passage 154 from relief chamber 215 through a resulting slot 217 as measured between the end 158*a* of pin 158 and the bottom 215*a* of the relief chamber.

With relief chamber 215, an O-ring type seal 220 can now be installed at the inner-most end of passage 154 in sealing contact with pin 158 to prevent dirt and CM material from entering the cartridge interior along the passage 158. Additionally, dirt and CM material are prevented from entering the cartridge interior from annular relief chamber 215 (i.e., through hole 156 and passage 154 intersecting the chamber) by the provision of a circular air filter 221.

Still with reference to FIG. 16, the improved plunger arrangement includes a manifold member 178 having an outer diameter of approximately 1 inch and not one-and-a-half inches as in the case of manifold 78 of FIG. 9. In other words, manifold member 178 is formed to have a diametral ratio of about 1-to-3 relative to the outer diameter of plunger 164 whereas manifold 78 of FIG. 9 has a diametral ratio of about 1-to-2 relative to plunger 64 therein. With manifold 178, there is now an increased surface area 196*a* of annular ring 196 against which surface compressed air is exerted to retract plungers 164 and 166. This greater surface area means that a greater retraction force is now exerted against each plunger in the retraction mode to enhance production throughput.

In accordance with another improvement feature of this invention, manifold support ring 80 of FIG. 9 is preferably replaced with a cross-shaped retainer 230 depicted in FIG. 17. The cross-shaped retainer 280 is formed with less material than the solid circular ring 80 and is therefore of lighter weight due to its shape. The improved manifold support ring 230 is formed with four radial arms 230*a*, 230*b*, 230*c*, and 230*d*. The upper vertical arm 230*a* and horizontal arms 230*b*, 230*c* are preferably supported within cylindrical assembly sleeve 162 with machine screws 232 extending through apertures in the wall of assembly cylinder 162 as depicted in FIGS. 16 and 17.

The lower arm 230*d* of manifold support 230 is formed with a pair of longitudinally-spaced radial passages 110 and 112 in place of the corresponding passages depicted in manifold support 80 of FIG. 9. Passages 110 and 112 respectively supply pressurized air to longitudinally-extending passages 108 and 109 in the manifold in a manner substantially identical to that depicted in FIG. 9 albeit through a pair of fittings 233 respectively threadedly secured to each passage. With reference to FIG. 17, an opening 233*a* is formed in the bottom center portion of the cylindrical sleeve or cartridge 162 to enable the fittings 233 to be threadedly secured to their passages 110 and 112.

Figure 11:
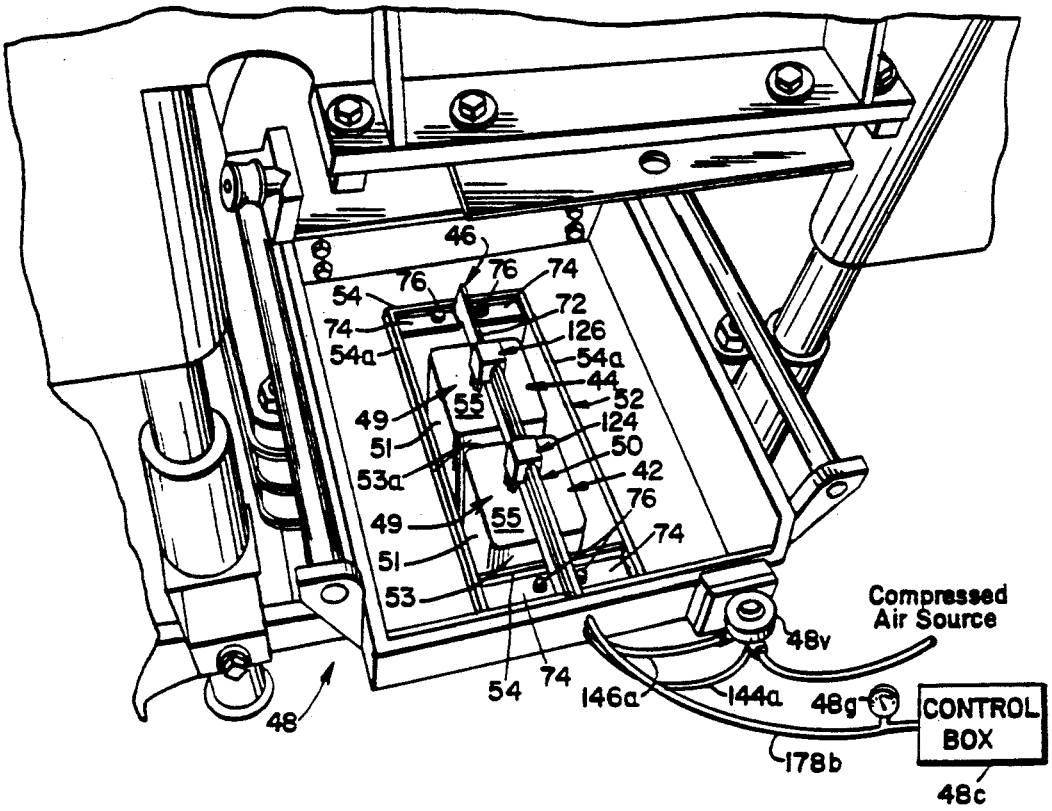
FIG. 11 is a perspective view showing part of a conventional CM block casting machine and the biaxial CM mold core system and related components shown in FIGS. 9 and 10 installed in the CM block casting machine with the two mold cores of said system disposed in the mold box of the casting machine.
Figure 12:
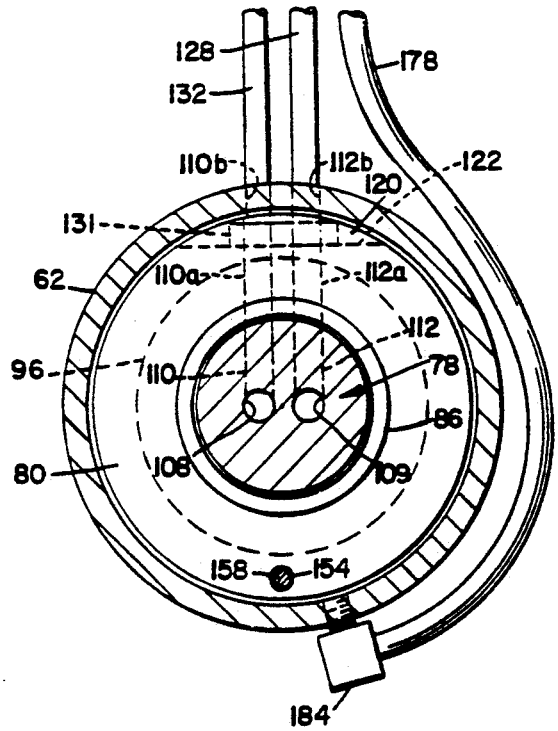
FIG. 12 is a cross-sectional view of the biaxial plungers sub-assembly shown in FIG. 9, taken along line 12—12 of the mold core shown at the right side of FIG. 9.
Figure 13:
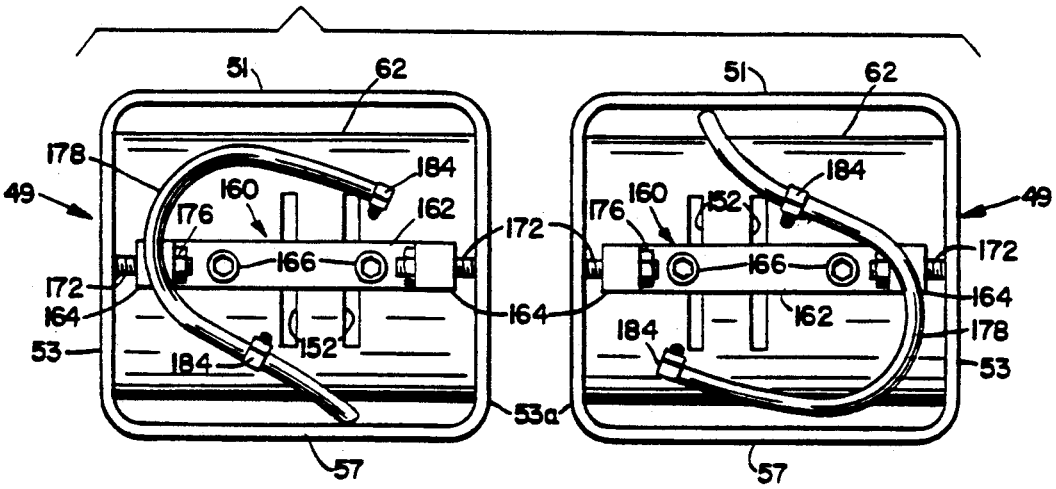
FIG. 13 is a bottom plan view of the mold core assemblies shown in FIGS. 9 and 10, looking upwardly along line 13—13 in FIG. 9.
Figure 14:
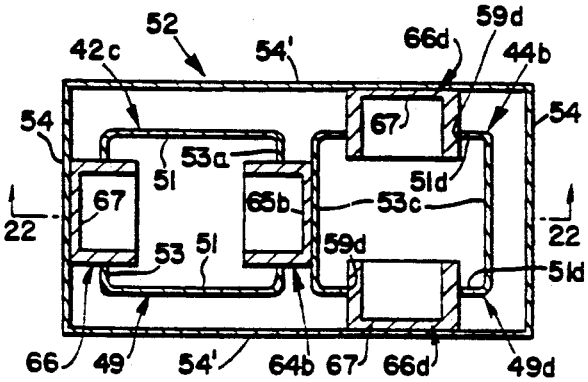
FIG. 14 is a schematic illustration of a modified biaxial CM casting apparatus for use in a biaxial CM casting process to make biaxial CM "T-blocks" according to the present inventions.

Airlines (not shown) extend directly from these fittings to a valve assembly of the type depicted in FIG. 11 to supply (and exhaust) compressed air to the plungers 164 and 166 in their extension and retraction mode.

Figure 19:
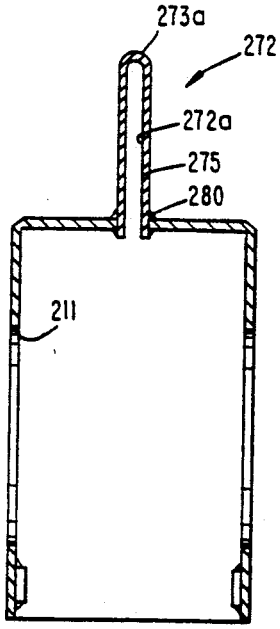
FIG. 19 is a sectional view taken along the line 19—19 of FIG. 18.

With reference to FIGS. 18 and 19, another improvement feature of the present invention is the provision of forming the core bar 72 in FIG. 9 as a hollow core bar 272 adopted to carry the air tubes and conduits 128, 132 and 178 within interior hollow region 272*a* thereof. Hollow core bar 272 advantageously eliminates coupling blocks 124, 126 in FIG. 9 by allowing lines 128, 132 and 178 to extend continuously from fittings 233 through the hollow core bar to an appropriate valving member of a type depicted in FIG. 11.

As best depicted in FIG. 19, hollow core bar 272 is preferably formed from an elongate, rigid member bent onto itself along a longitudinal axis to form a pair of spaced sidewalls 273 connected at their upper portions by the bended portion 273*a*. The lower edges of the sidewalls may be welded together at portions 280 between the mold cores; the lower edges of the sidewalls 273 is coextensive with the top wall 55 of the mold cores are welded thereto to enable the interior hollow region 272*a* to communicate with the mold core interior (FIG. 19). Thereby, the conduits 128, 132 and 178 may extend continuously through the hollow core bar 272 and be protected from the external surroundings thereby and then enter the mold cores to be snaked around the plunger cartridges 162 for connection to the fittings 233.

Figure 20:
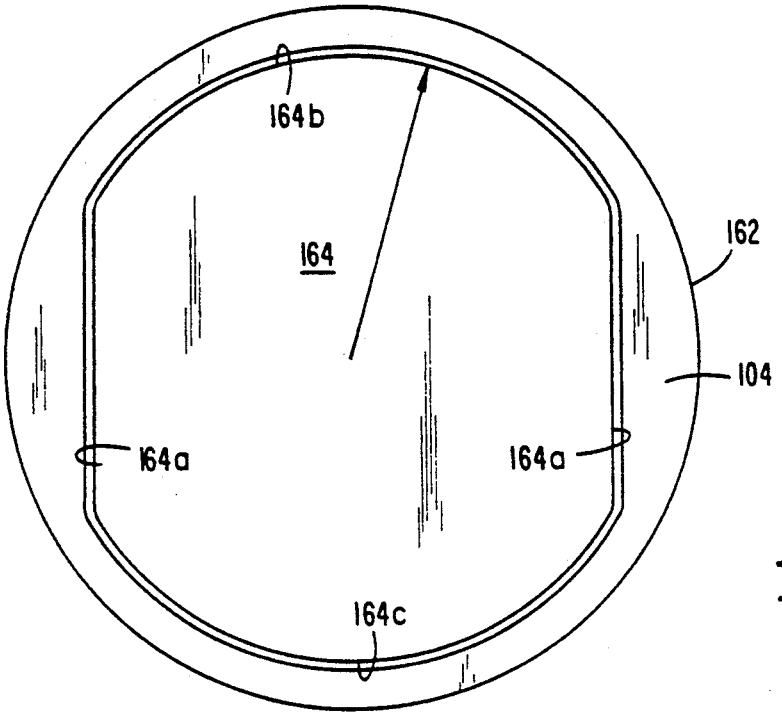
FIG. 20 is a partly sectional and partly schematic view of a modified plunger in accordance with the present invention.

Plungers 164 and 166 may be of circular cross section as are plungers 64 and 66 of FIG. 9. However, in accordance with a further improvement feature of this invention, as depicted in FIG. 20, each plunger 164, 166 may be of non-circular cross section and preferably formed with vertical side faces 164*a* spaced from the central longitudinal axis L of the plunger a distance less than the radius of curvature R of the top and bottom arcuate sections 164*b* and 164*c* of the plunger. In other words, the improved plunger of FIG. 20 is preferably housed within a cylindrical cartridge or sleeve housing 162 (as are the circular cross section plungers of FIG. 16), however, the sweeper gaskets 104 and 104*a* are preferably formed to have an internal cross section corresponding to the cross section of the improved plunger as is the over-sized wiper ring 202. With this arrangement, i.e., a new geometry wherein the plunger has less width dimension in the horizontal axis than its height dimension in the vertical axis, the vertical flow channels on either side of the plunger are increased (vis-a-vis a plunger of circular cross section R as in Figure a) to enable additional CM material to fill the mold cavity beneath and in substantially full contact with the lower surfaces 164C of the plunger.

By providing larger vertical flow channels and thereby imposing fewer flow constraints on the liquid material being fed into the mold box, flow cracks and transfer bulging of the blocks is advantageously kept to a minimum. As a result of extensive experimentation, flow cracks are the most damaging and obvious quality defects encountered in the manufacture of biaxial blocks, particularly as applicable to the use of lightweight aggregates in the southern United States. These cracks are visible at around four and eight o'clock around the biaxial openings, evidencing the difficulty encountered by the material inflowing under the biaxial plungers. Transverse bulging of the blocks results when material flow is enhanced through the increase of water content in the CM mix, or the addition of flow admixtures, in order to minimize the cracks around the lower hemisphere of the biaxial hole. In these cases, the green product becomes more plastic, and is deformed by the thrusting forces imparted horizontally from the arching action of the material above the biaxial hole. Bulging is therefore minimized with the new geometry of the plunger and hole as described above.

From the foregoing, it will occur to one of ordinary skill that the cross section of plunger 162, 164 need not be defined by a vertically extending side faces as depicted in the plunger cross section of FIG. 20. The plunger cross section may be oblong or of another shape wherein the horizontal shape is less than the vertical dimension as aforesaid.

Figure 4:
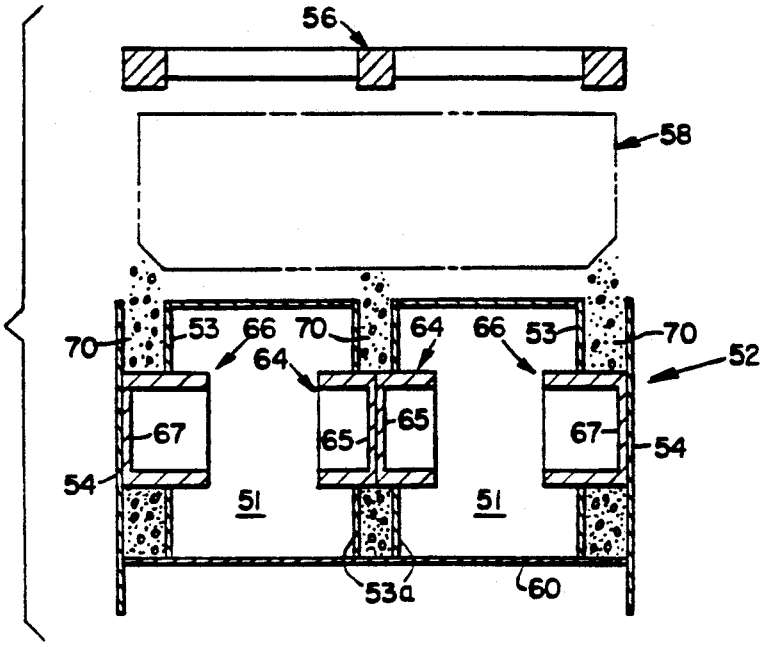
FIG. 4 is a schematic of the biaxial CM casting apparatus components shown in FIG. 3 but in another phase of the process wherein semifluid concrete masonry mix is being fed into the mold cavity while said axial plungers are extended from the biaxial CM mold cores.
Figure 5:
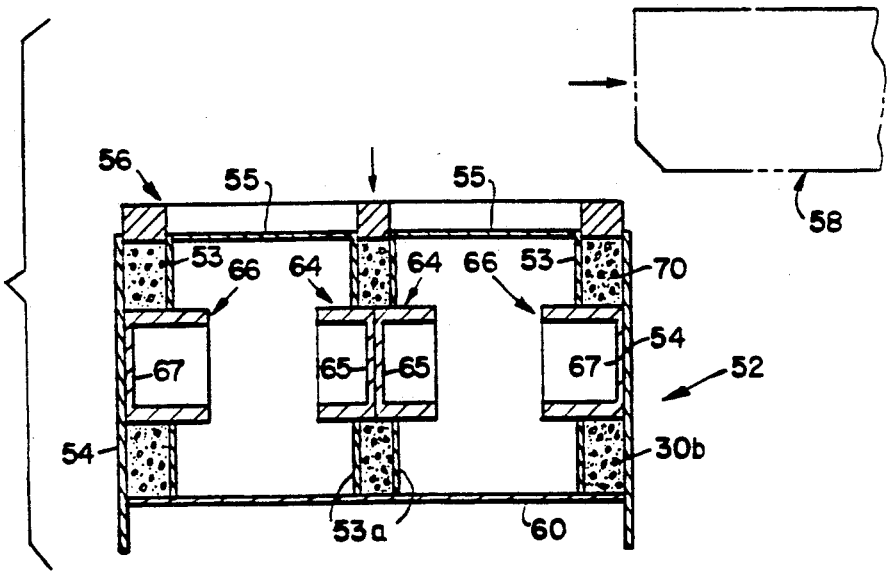
FIG. 5 is a schematic of the apparatus of FIG. 4, but shows another phase of the process wherein the feed tray has withdrawn and the stripper shoe has come down to compress the CM mix in the mold as vibration proceeds while said axial plungers are extended from the biaxial CM mold cores.
Figure 6:
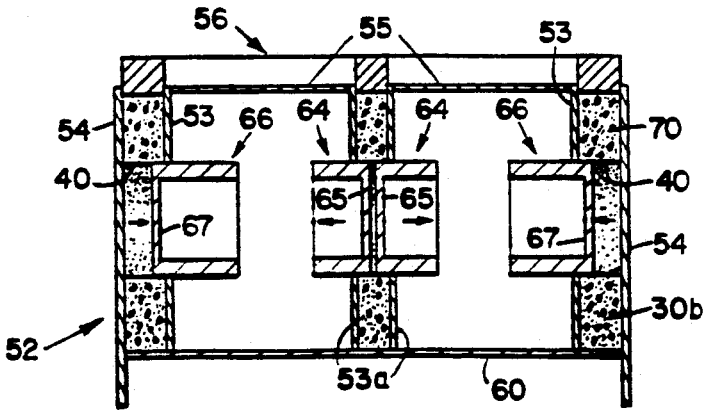
FIG. 6 is similar to that of FIG. 5 but shows another phase wherein the axial plungers are being retracted to inside the biaxial mold cores after completion of the CM block compression cycle.
Figure 7:
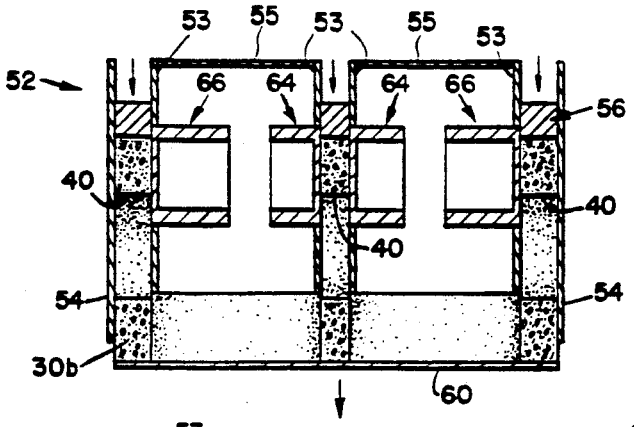
FIG. 7 is similar to FIG. 6 but shows another phase wherein the axial plungers are fully retracted within the hollow mold cores and the compressed CM material formed into a CM block is being stripped from the mold cavity through simultaneously downward motion of the compression/stripper shoe and the bottom pallet.
Figure 8:
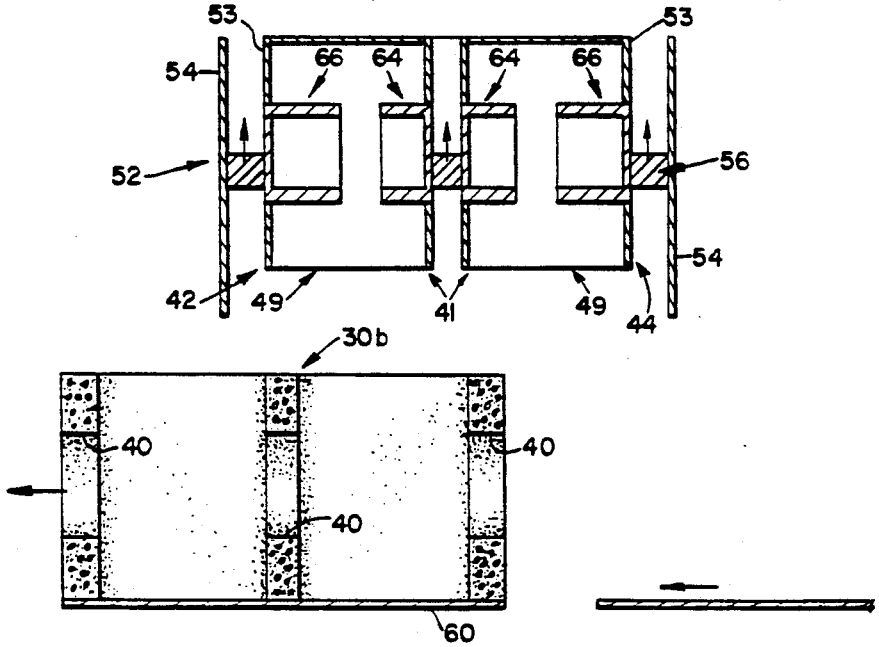
FIG. 8 is a schematic drawing showing various components of the biaxial CM casting apparatus shown in FIGS. 2 through 7, but FIG. 8 illustrates another phase of the process wherein the compression/stripper shoe returns upward past the axial plungers which are retracted within the biaxial CM mold cores, while the newly cast CM block is being ejected on its individual pallet onto a conveyor—whereby the steps of FIGS. 2 through 7 can be repeated when the compression/stripper shoe moves upwardly out of and above the mold box.
Figure 10:
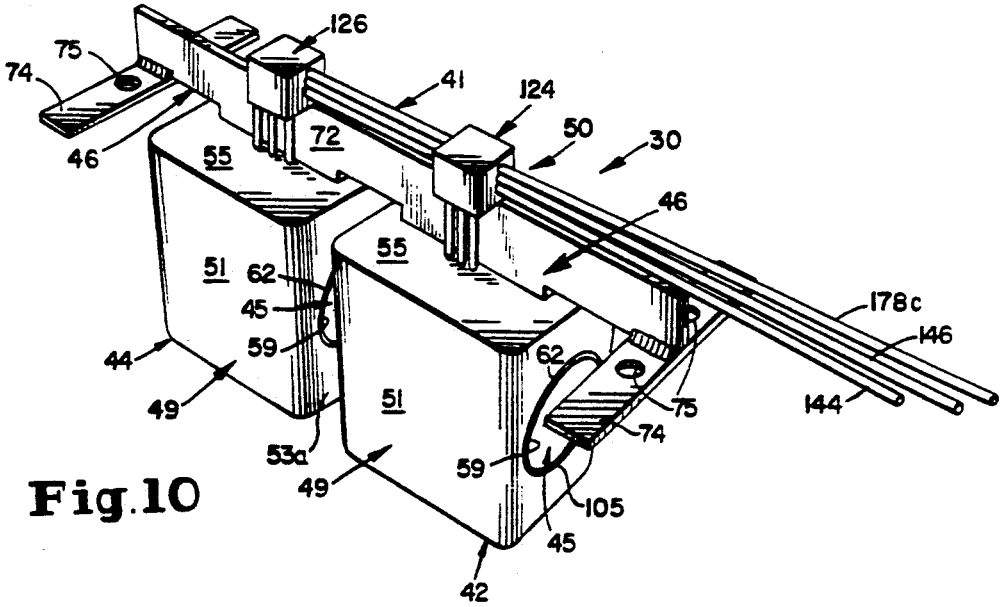
FIG. 10 is a perspective view (looking from the top) of the biaxial CM mold core system plus related mounting means and air conduit means shown in FIG. 9.
Figure 21:
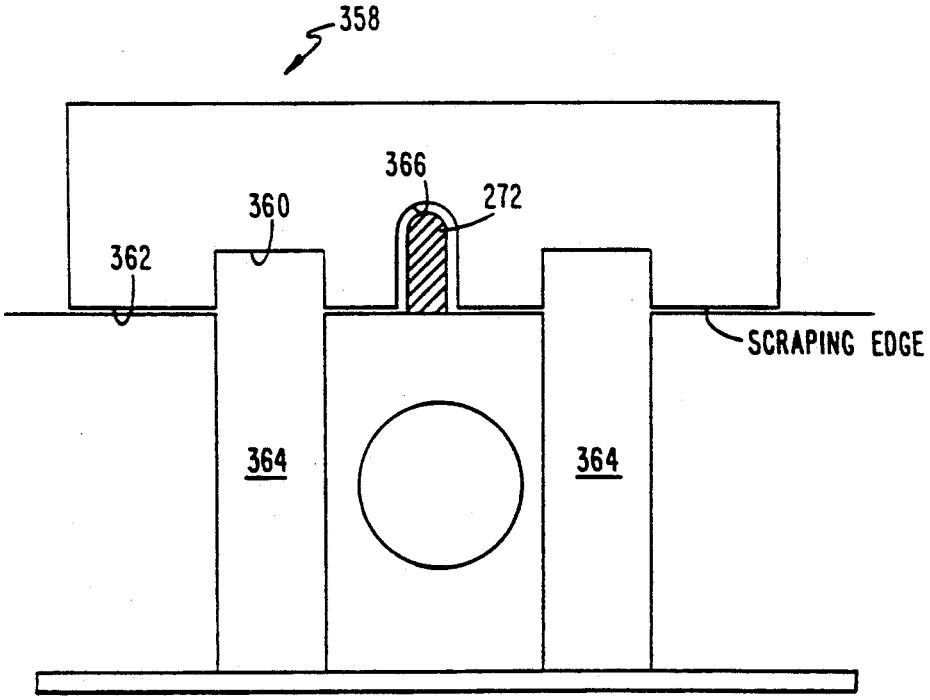
FIG. 21 is a partial schematic and partial sectional view of a modified strike-off bar in accordance with the present invention.

Subsequent to introduction of CM material with feed tray 58 into the mold cavity as depicted in FIG. 4 and prior to movement of compression/stripper shoe 56 into descending contact with the CM material as depicted in FIG. 5, it is conventional practice to remove excess quantity of CM material (projecting upwardly from the top end walls 55 of the mold cores) by means of a strike-off bar (not shown) having a scraping edge which is continuously co-planer with the top end walls 55. As discussed supra, such a conventional strike-off bar results in insufficient CM material filling the mold core cavities beneath the plungers 164 and 166. Undesirable voids are therefore created in the finished product beneath the biaxial holes. To avoid this problem, an improved strike-off bar 258 as depicted in FIG. 21 is formed with indentations along its lower scraping edge 362 which are in vertical alignment with longitudinally-extending sections 364 of the mold cavity. The length of each indentation 360 generally matches the cavity width and has a depth extending into the strike-off bar 358 of approximately one inch. The strike-off bar 358 further includes a clearance notch 366 through which the hollow core bar 272 moves as the strike-off bar 358 is translated in a known manner in scraping contact with the top end wall 55 of the mold cores and adjacent mold box.

With this arrangement, additional CM material corresponding to the cross sectional area of the indentations and extending the length of the mold cavity is allowed to remain in position projecting above the top end wall 55 until the compression/stripper shoe 56 descends into contact with this material as depicted in FIG. 5. This additional material is then compressed into the mold core cavities and especially beneath the plungers (i.e., in contact with surface 164*c*) where voids tend to be created due to the biaxial geometry, allowing for production of a superior product.

The improved strike-off bar 358 provides a means to selectively deposit more material above areas requiring larger volumes of such material. It will be understood that strike-off bar 358 may be applied in conjunction with non-biaxial situations, i.e., in situations where strike-off bar technology is used and in substitution for conventional strike-off bars.

Figure 1:
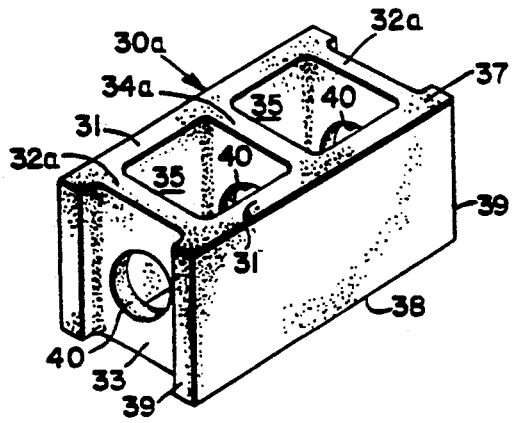
FIG. 1 is an isometric view of a biaxially cast CM block which is generally similar to a conventional CM block but formed with apertures in the center and two end webs thereof and made during casting using the improvement apparatus for biaxial casting according to the invention.
Figure 2:
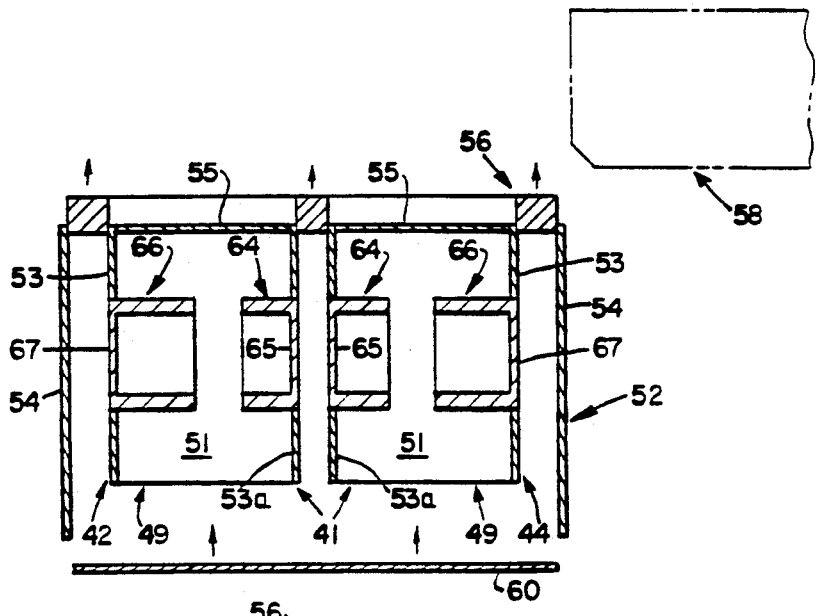
FIG. 2 is a schematic or diagrammatic illustration of components of a biaxial CM casting apparatus in one phase of a biaxial CM casting process for making biaxial CM blocks according to the present invention.
Figure 3:
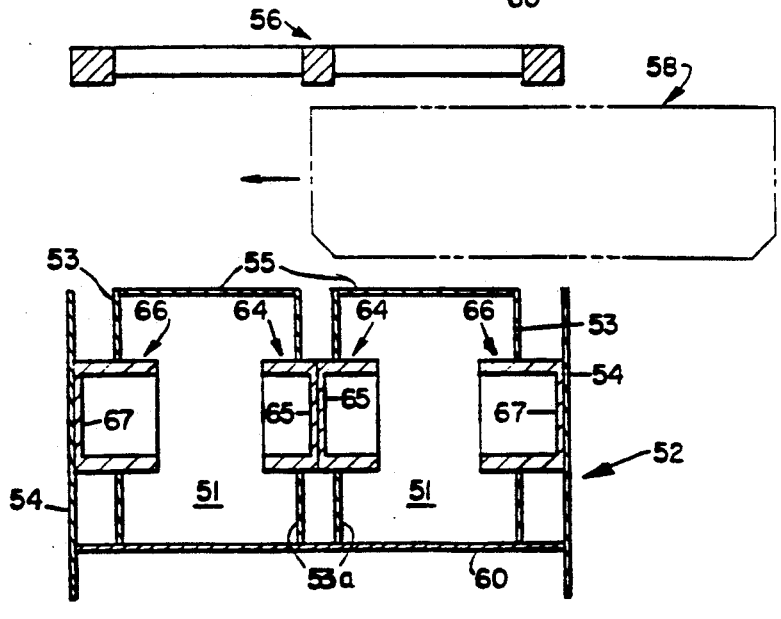
FIG. 3 is a schematic of the biaxial CM casting apparatus components shown in FIG. 2 but in another phase of the biaxial CM casting process wherein the bottom pallet is in place and the axial plungers are extended from the biaxial CM mold cores (whereas in FIG. 2 such axial plungers are retracted within such cores).
Figure 22:
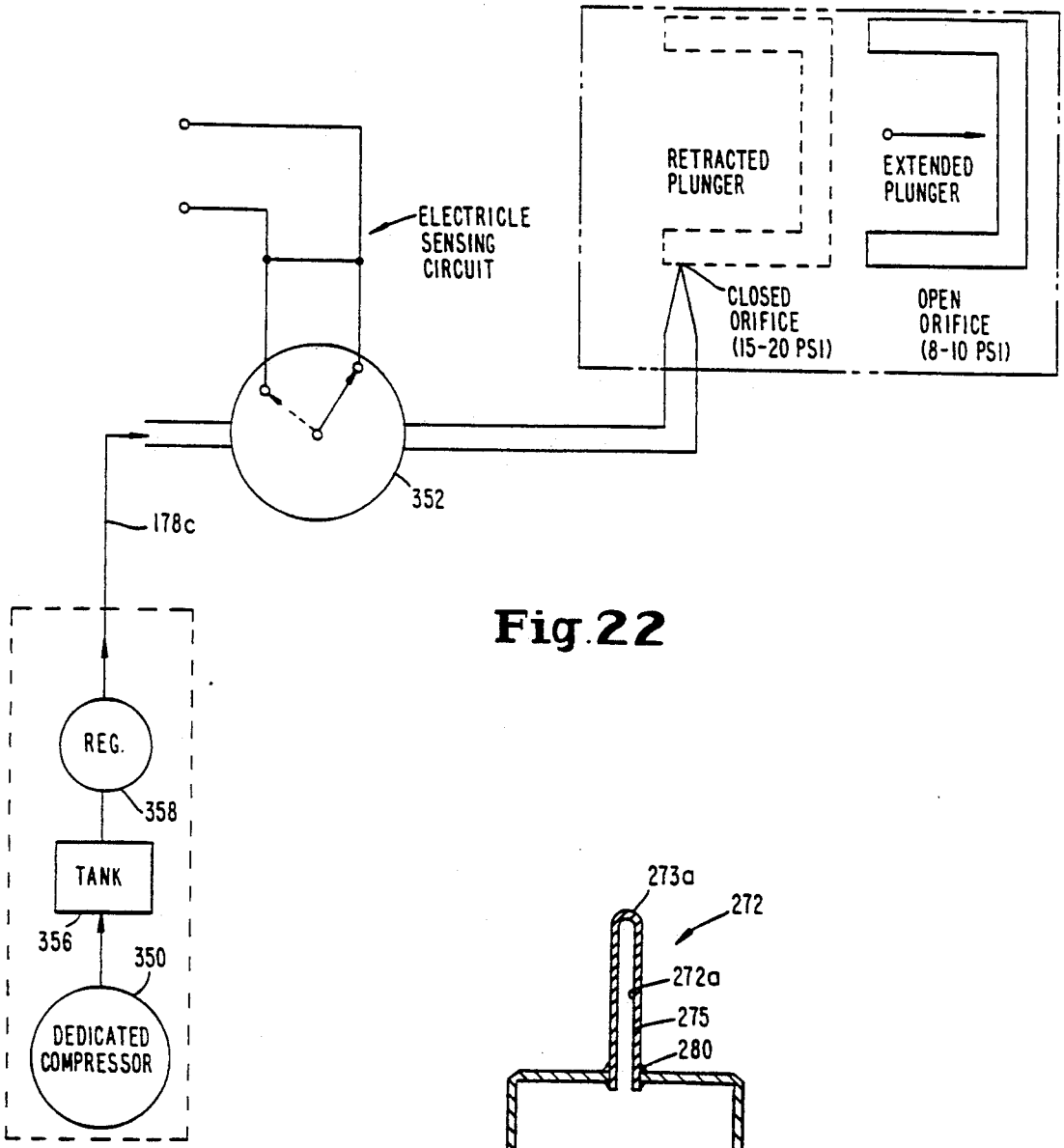
FIG. 22 is a diagrammatic view of an improved fail-safe system for sensing full retraction of the plunger.

In my mold core assembly as depicted in FIGS. 2 and 11, and as discussed above, each of lines 148, 150 supplying compressed air to extend and retract the plungers and line 178 supplying low pressure compressed air to differential pressure sensors 184 were all supplied by the same compressor (i.e., Compressed Air Source in FIG. 11) which resulted in a variable flow of air to the pressure gauge to which the nipples or differential pressure sensors 184 were connected. To assure a constant pressure air flow to line 178*c* and the pressure gauge, the present invention provides a dedicated air compressor 350 as depicted in FIG. 22, supplying low pressure air to the gauge 352 through an accumulating tank 354. The tank 354 has a pressure regulator 358 maintaining a constant pressure flow (e.g., 15–20 psi) into the low pressure line feeding to the pressure gauge. The lines (not shown) attached to fittings 233 continue to be supplied with compressed air from a different compressor source (e.g., FIG. 11).

As described above, the differential-pressure sensing arrangement constitutes a fail-safe system which provides an automatic means by which the plunger position may be monitored, particularly to insure that full retraction has occurred before mold stripping is affected. The speed and great force exerted by a block machine upon stripping makes it imperative that all biaxial plungers be fully retracted and out of the way in order to prevent potentially disastrous hardware collision within the mold box. While the air pressure-sensing system described supra currently constitutes an optimal fail-safe sensing system, one of ordinary skill will appreciate that other fail-safe sensing systems may be employed within this invention and their practicality will vary as a function of the current state of technology. For example, electrical micro switches positioned within the cartridge housing 62 or 162 may provide another approach to determining full or partial extension or retraction of the plungers due to their compact size and clean connections in series with the stripping loop of the block machine. Nevertheless, their susceptibility to damage through vibration makes their current durability questionable. Fiber optic sensors and solid state proximity sensors may also provide an effective alternative to air pressure sensing.

In the mold core assembly of FIG. 9, the plungers extend their entire stroke and there is no disclosed means for controlling movement of the plunger. Therefore, in accordance with a further improvement feature of this invention, the extension of plungers 164, 166 is controlled by means of stop screws 285 (FIG. 16 right-hand plunger only for purposes of illustration) threadedly secured at 286 within annular rings 196 to project inwardly into the plunger interior a predetermined distance D. During extension of the plungers, the distal end 285*a* of the stop screw 285 abuts against the inner face 87*a* of piston member 87 and, in this manner, prevents further extension of the plunger. With this arrangement, biaxial recessor knock-outs may be formed in the CM block in place of biaxial openings. The knock-outs may be selectively ruptured at the job site to create biaxial openings as necessary.

To control the depth of the knock-out (i.e., recess formed in the block wall with the biaxial plunger), stop screws 285 of different lengths are inserted into the annular rings 196. To obtain full extension of the plungers, stop screws having a thickness equal to the thickness of the annular ring (not shown) are secured in the threaded openings 286.

It is within the scope of this invention to form one or more indentations on one or more exterior faces of a CM block, for decorative or architectural relief purposes, or simply as a means of forming knock-outs or biaxial openings from outside the block and mold cavities thereof, such as by placement of one or more plungers in circular openings formed in the mold box walls. In this type of arrangement, the mold cores may be conventional (e.g., formed without retractable plungers) and the plungers as depicted in FIGS. 9 or 16 may be mounted within the mold box wall (with suitable brackets as will occur to one of ordinary skill) with the outside end face of the plunge flush with the mold box wall in the retracted position of the plunger. In this modified arrangement, the cartridge 162 would contain only one plunger adapted to project inwardly into the mold cavity from the mold box wall. Of course, if desired, this type of mounting of the plungers within the mold box wall may be used in conjunction with the mold core assemblies of FIGS. 9 or 16 wherein biaxial openings or knock-outs are selectively formed from within the block.

It will be readily seen of one of ordinary skill in the art that the present invention fulfills all of the objects set forth above. After reading the foregoing specification, one of ordinary skill will be able to effect various changes, substitutions of equivalence in various other aspects of the inventions as broadly disclosed herein. It is therefore intended that the protection granted hereon be limited only by the definition contained in the appended claims and equivalence thereof.

I claim:

1. A CM casting machine for making a concrete masonry or CM block including at least one face shell, comprising a mold and a biaxial casting apparatus disposed in the mold of the machine with said mold including a mold box comprising side wall means and a movable bottom, said biaxial casting apparatus comprising at least one mold core means forming a mold cavity with said side wall means, and means operatively mounted adjacent the cavity for projecting laterally into the mold cavity along an axis transverse to the side wall means during selected phases of using said apparatus and casting a concrete masonry block; and control means for selectively extending and retracting said laterally projecting means, said machine further including a cartridge housing operatively mounted adjacent the cavity with said laterally projecting means including a plunger slidably disposed within the housing, seal means in said housing in sealing contact with the periphery of the plunger for preventing entry of dirt and CM material from within the mold cavity, during casting, into the housing interior, and said machine further including an oversize wiper ring loosely mounted in the housing for vibratory contact with the external periphery of said plunger.

2. The machine of claim 1, wherein said seal means includes a pair of seals in sealing contact with the external periphery of the plunger, said oversize wiper ring being mounted between said pair of seals.

3. The machine of claim 2, wherein said cartridge housing is disposed in said mold core means and said side wall means of the mold core means includes an open bottom, and further including air filter means in said open bottom to prevent entry of dirt into the interior of the mold core means.

4. The machine of claim 2, wherein said plunger includes an air passage communicating the interior of the cartridge housing with an exterior end face of the plunger to provide air from the housing interior to the plunger end face during plunger retraction to thereby destroy the vacuum created between the plunger end face and one of CM material or side walls of the mold box in contact with it, a pin stationarily mounted to slidably translate within the air passage during plunger movement, said pin substantially occupying the passage when the plunger is fully retracted to prevent dirt and CM material from entering the cartridge housing interior through the passage, and further including an annular relief chamber formed in a side wall of the plunger in communication with the air passage to provide an additional volume of air through the passage to the plunger end face to break up the vacuum effect.

5. A biaxial casting apparatus for making a concrete masonry or CM block including at least one face shell, said apparatus adapted to be disposed in the mold of a CM casting machine with said mold including a mold box comprising side wall means and a movable bottom, said biaxial casting apparatus comprising at least one mold core means forming a mold cavity with said side wall means, said mold core means including means for laterally projecting outwardly from the side wall means of the mold core means into the mold cavity along an axis transverse to the side wall means during selected phases of using said apparatus and casting a concrete masonry block; and control means for selectively extending and retracting said laterally projecting means, wherein said laterally projecting means is a plunger mounted within a cartridge housing contained within the mold core means, wherein said plunger includes an air passage communicating the interior of the cartridge housing with an exterior end face of the plunger to provide air from the housing interior to the plunger end face during plunger retraction to thereby destroy the vacuum created between the plunger end face and one of CM material or side walls of the mold box in contact with it, a pin stationarily mounted to slidably translate within the air passage during plunger movement, said pin substantially occupying the passage when the plunger is fully retracted to prevent dirt and CM material from entering the cartridge housing interior through the passage, and further including an annular relief chamber formed in a side wall of the plunger in communication with the air passage to provide an additional volume of air through the passage to the plunger end face to break up the vacuum effect.

6. The apparatus of claim 5, further including a circular air filter disposed in the annular relief chamber to prevent dirt and CM material from entering the housing interior through the air passage and then through the annular relief chamber.

7. The apparatus of claim 6, further including sealing ring means mounted adjacent an inner end face of the plunger in sealing contact with the pin to prevent CM material from entering the housing interior along the pin periphery.

8. The apparatus of claim 5, further comprising a stationary manifold, a manifold support in the cartridge housing in which the manifold is mounted, a distal end of said manifold carrying a piston received in a hollow region of the plunger, said piston dividing the hollow region of the plunger into a first region defined between the end face of the plunger and the piston and a second region defined between an annular ring closing off the hollow region and the piston, air passageway means in the manifold support and manifold in respective communication with said first and second regions, and air-fitting means mounted in the cartridge housing to the manifold support for selectively supplying compressed air through the air passageway means to one of said first and second regions to respectively extend or retract the plunger.

9. The apparatus in claim 8, wherein the ratio of an outer diameter of the manifold to an outer diameter of the plunger is approximately one to three.

10. The apparatus of claim 8, further comprising stop screw means threadedly mounted to the annular ring to project into the second region a predetermined extent, whereby extension of the plunger causes the distal end of the stop screw means to contact the piston to prevent and thereby control the degree of plunger extension.

11. The apparatus of claim 8, wherein said manifold support includes plural arms extending radially towards the cartridge housing and means for fastening distal ends of said arms to the cartridge housing to mount the manifold support within the cartridge housing, one end of said arms being formed with said air passageway means an inlet openings receiving said air-fitting means.

12. The apparatus of claim 8, further comprising core bar means for supporting the mold core means within the mold box, said core bar means including a hollow core bar having a hollow interior in communication with the hollow interior of the mold core means.

13. The apparatus of claim 12, further including air tubings extending continuously through the hollow core bar means into the mold core means into engagement with said air-fitting means from a means for supplying compressed air into the mold core means.

* * * * *